US009320979B2

(12) United States Patent
Ireland

(10) Patent No.: US 9,320,979 B2
(45) Date of Patent: Apr. 26, 2016

(54) SOUND DEFINITION LANGUAGE METHOD WITH INLINE MODIFIERS

(75) Inventor: Anthony J Ireland, Lynn Haven, FL (US)

(73) Assignee: A. J. Ireland, Panama City, FL (US)

( * ) Notice: Subject to any disclaimer, the term of this patent is extended or adjusted under 35 U.S.C. 154(b) by 609 days.

(21) Appl. No.: 13/506,917

(22) Filed: May 24, 2012

(65) Prior Publication Data

US 2012/0272069 A1 Oct. 25, 2012

Related U.S. Application Data

(62) Division of application No. 11/324,071, filed on Dec. 30, 2005, now Pat. No. 8,229,582.

(51) Int. Cl.

| | |
|---|---|
| ***G06F 17/00*** | (2006.01) |
| ***A63H 19/24*** | (2006.01) |
| ***A63H 19/00*** | (2006.01) |
| ***A63H 19/14*** | (2006.01) |

(52) U.S. Cl.
CPC ..... *A63H 19/24* (2013.01); *A63H 19/00* (2013.01); *A63H 19/14* (2013.01)

(58) Field of Classification Search
CPC ..... A63H 19/14; A63H 19/00; A63H 19/64
USPC ..... 700/94
See application file for complete search history.

(56) References Cited

U.S. PATENT DOCUMENTS

| | | | | |
|---|---|---|---|---|
| 2002/0113171 | A1* | 8/2002 | Katzer | 246/124 |
| 2004/0010356 | A1* | 1/2004 | Lenz | 701/19 |
| 2006/0100753 | A1* | 5/2006 | Katzer | 701/20 |

* cited by examiner

*Primary Examiner* — Joseph Saunders, Jr.

(57) ABSTRACT

A method and apparatus is shown to allow the creation of sound programmers and complementary sound decoders that may be securely downloaded with sound and IPL data and that will operate in power limited environments with resistance to power drop outs and are significant improvements beyond prior art devices.

15 Claims, 5 Drawing Sheets

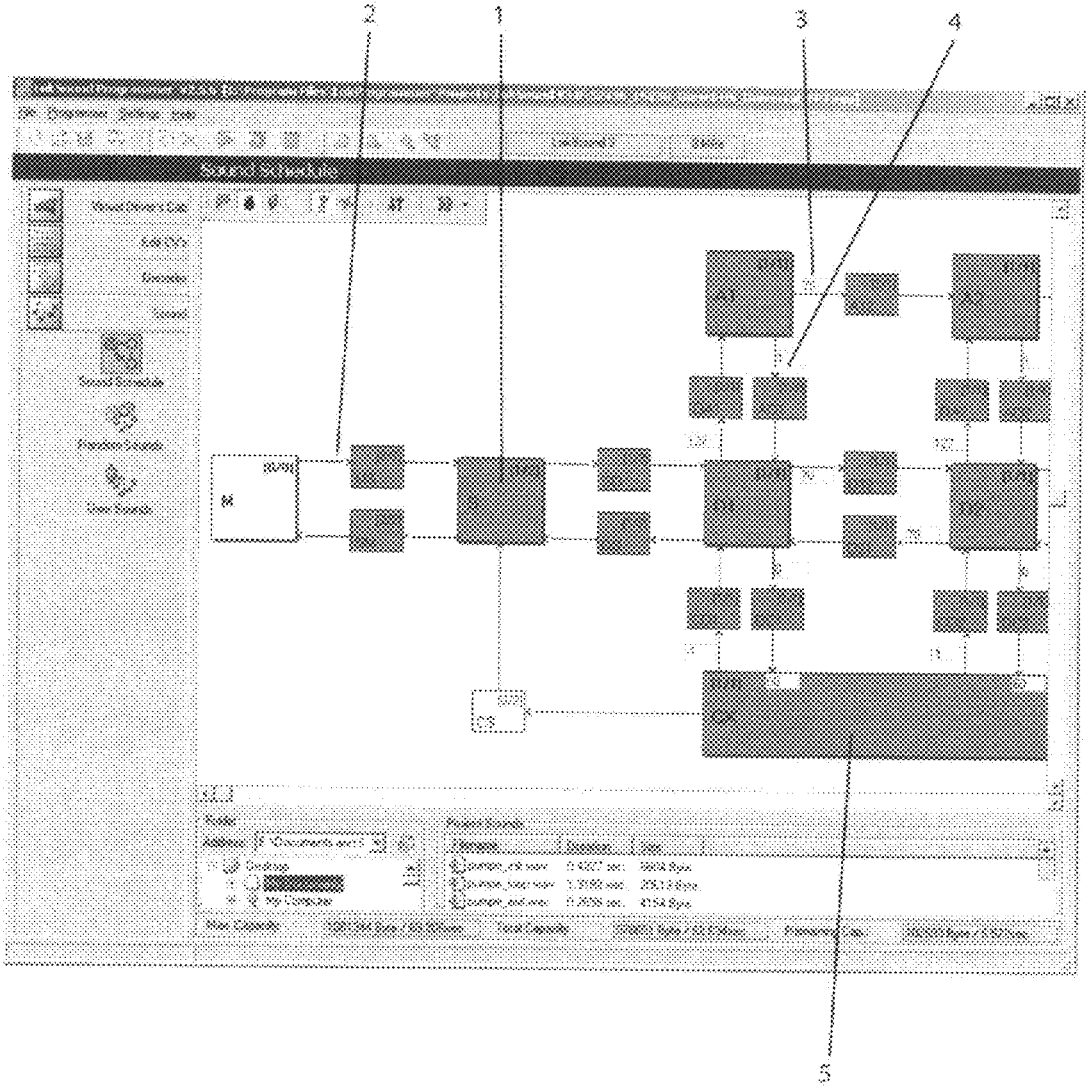
Figure 1: Prior Art

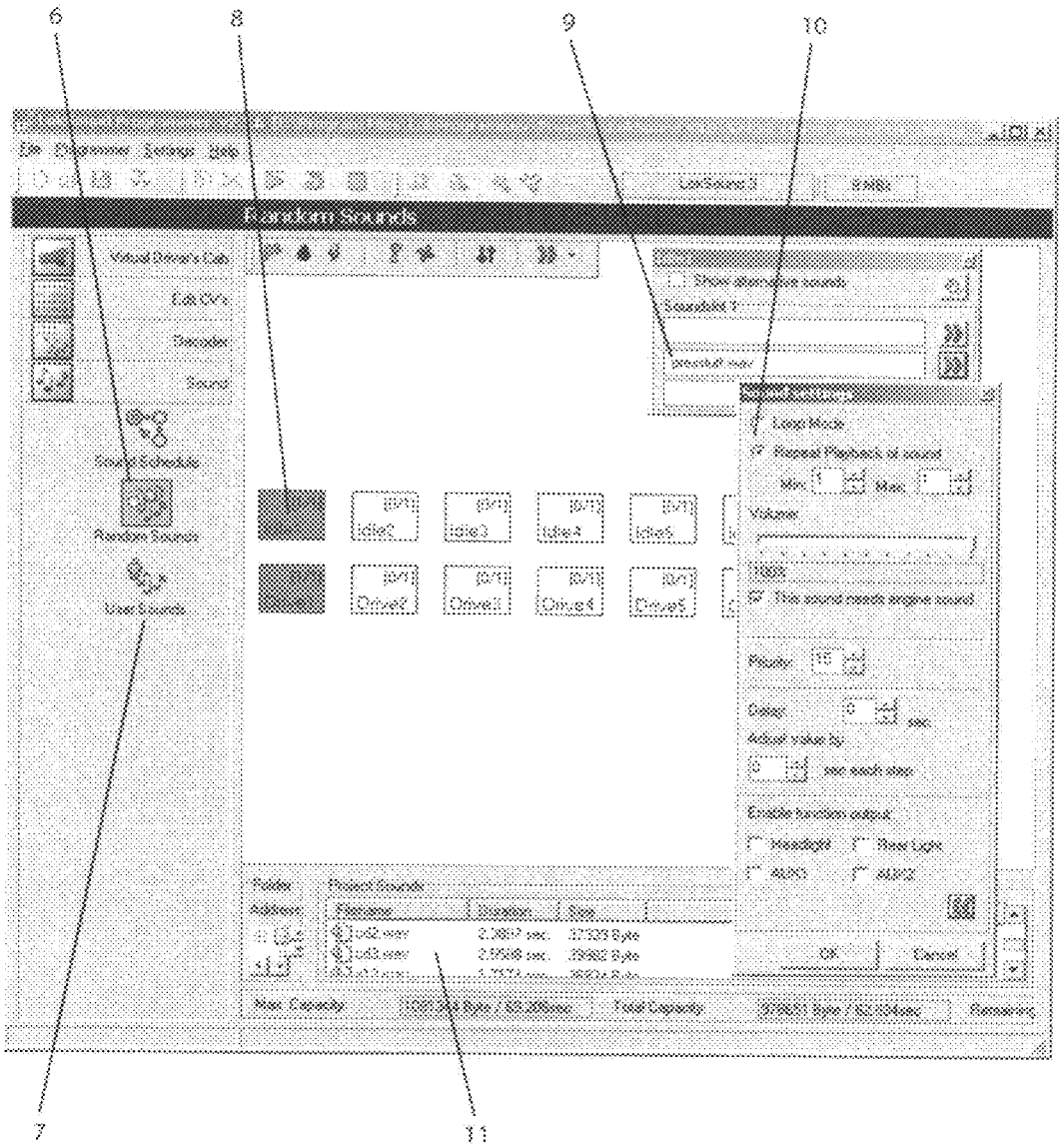
Figure 2: Prior Art

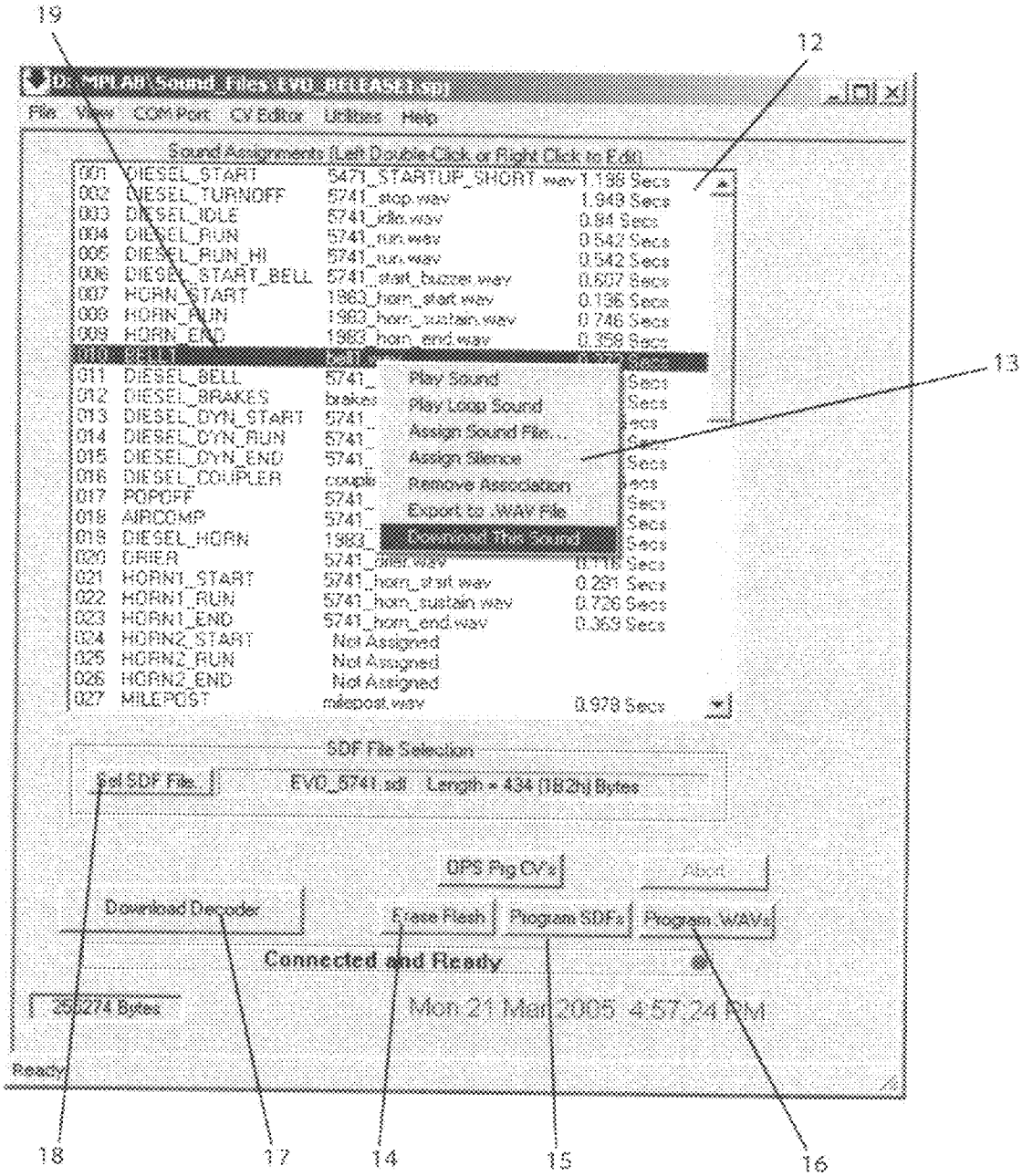
Figure 3: New Art

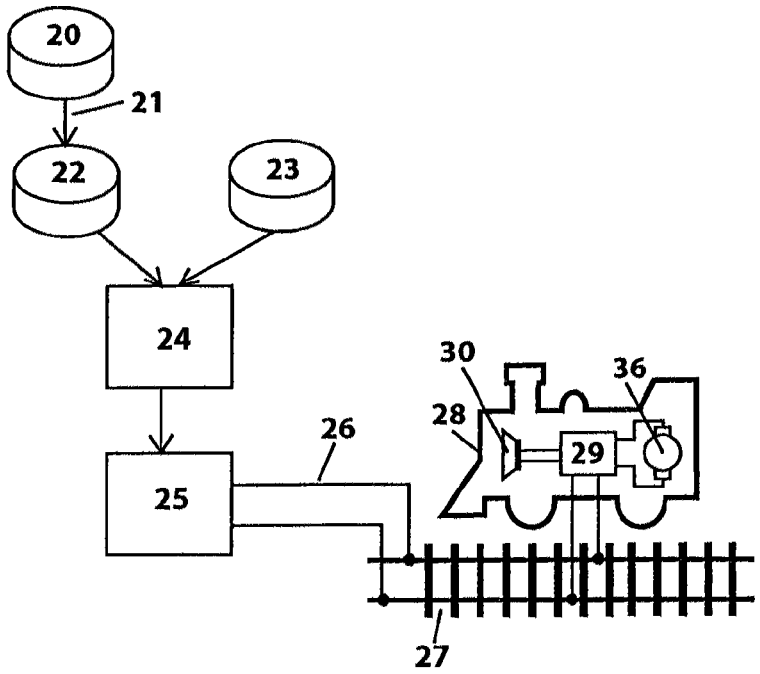
Figure 4: New Art
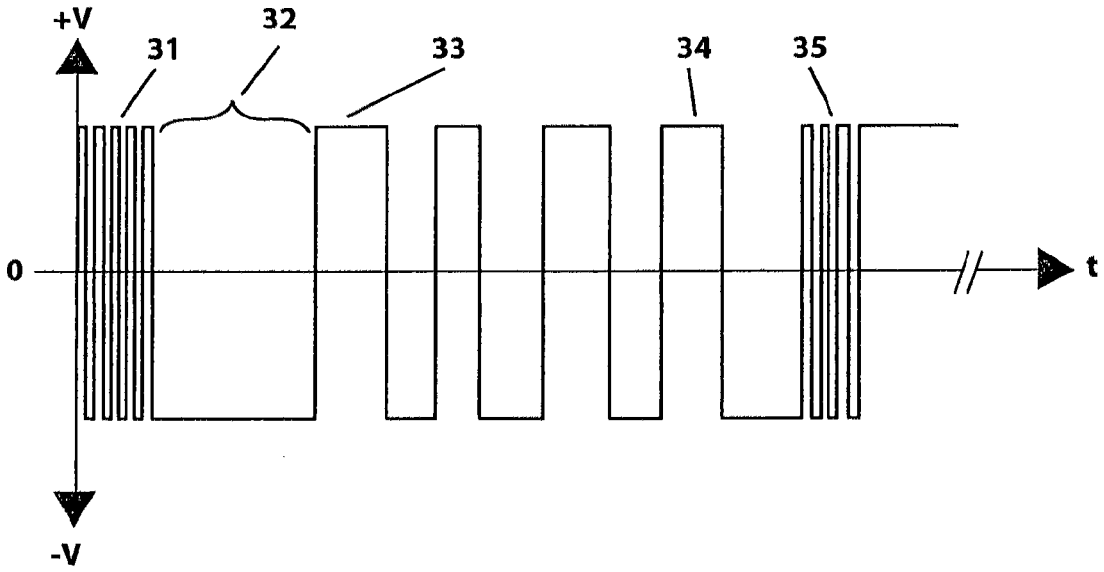
Figure 5: New Art

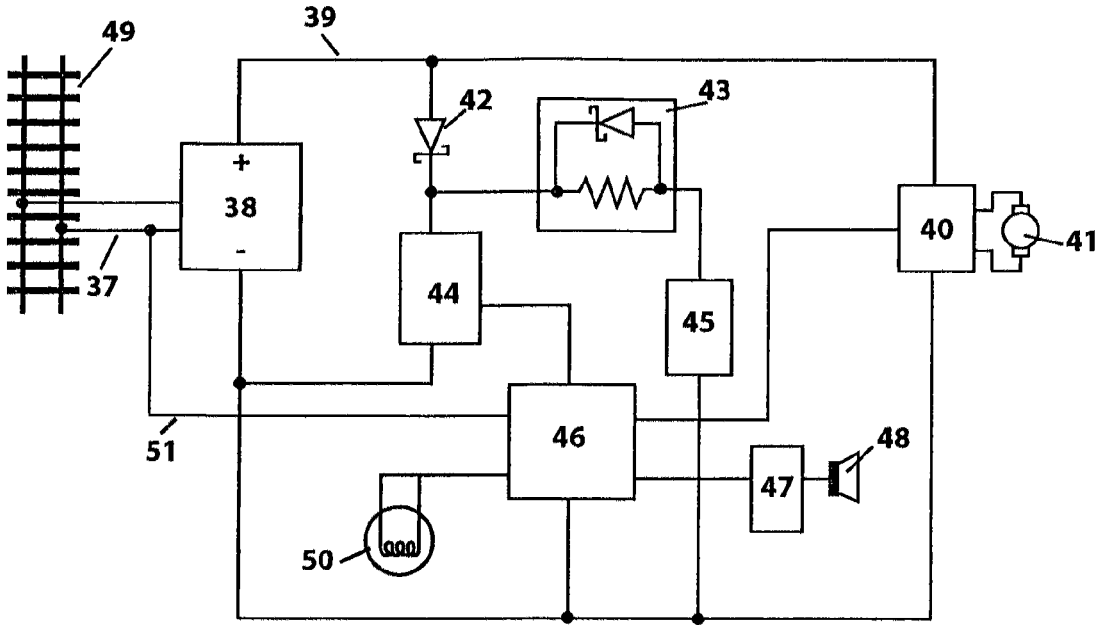
Figure 6: New Art

SOUND DEFINITION LANGUAGE METHOD WITH INLINE MODIFIERS

This disclosure is a Divisional prosecution from application Ser. No. 11/324,071 filed Dec. 30, 2005 now U.S. Pat No. 8,229,582

This disclosure contains material that is copyrighted and for which all rights are reserved. This copyrighted material may not be used for commercial purposes without written permission of the copyright holder, but may be used as required for the prosecution of this application by the Patent and Trademark Office.

FIELD OF THE INVENTION

This invention pertains to the field of electronic sound generation and control systems for model railroad layouts, and specifically to expanding the control of layout sound effects generators that are configurable and customizable by end users.

BACKGROUND OF INVENTION

The advent of Command Control technologies based on digital control signals has led to increased enjoyment and capabilities for model railroaders and their operations of model railroad layouts. Control technologies such as the widely used National Model Railroad Association Digital Command Control Standard (NMRA DCC) and others provide a rich set of control possibilities including the ability to control sounds in decoders in locomotive and modules on the layout. Accordingly, new generations of sound capable products that run on model railroads have been developed.

In the late 1980's Marklin GmbH of Goppingen Germany introduced an HO scale "dance car" sound-equipped coach that had sound effects controllable by function keys on their "AC Digital" digital control system. In the mid-1990's Marklin also introduced "1-Guage" locomotives incorporating digital sounds, motor and function decoders. Modern art sound generators suitable for use on model railroads have several broad logical elements: (a) the basic core is a decoder control means that has the electronic components and usually a data processor with associated decoder control software or firmware that can detect input voltages, external stimuli and commands and act to control any non-sound aspect such as a motor, (b) a sound control means that employs a configurable state machine or other sound sequencer control algorithm for animation of, (c) encoded sound fragments held by a sound storage means, that then may be combined by predetermined rules and output to a sound reproduction device such as a speaker. These three elements act in combination to provide an operative sound scheme that is intended to mimic some of the sounds of a real railroad.

In modern implementations these three elements are often (but not necessarily) animated by separate software algorithms that may execute on one or more cooperating data processors, and each aspect of these software implementations may benefit from the ability to be downloaded into an already installed decoder unit so as to be modified by an end user. Suitable high capability data processors with internal non-volatile storage for use in sound generators are available from many widely known integrated circuit manufacturers such as Intel Corp., Microchip Corp, Analog Devices Inc., Atmel Corp., Philips Nev., ST Corp., etc., as highly integrated function embedded control processors, microprocessors and even digital signal processors (DSP).

Novosel et al, in U.S. Pat. No. 5,855,004 teaches the benefit of digitally generated sounds in locomotive decoders when operating on an NMRA DCC control signal. This work was actually anticipated and demonstrated in the DSD2408 DCC sound decoder shown publicly by SoundTraxx, and also tested in the "1996 DCC Blowout" clinic, at the Amherst Model Train show at Springfield Mass., in February 1996, a full 14 months before being added as new matter to the Novosel '004 specification. The well-known magazine 'Model Railroader' in October 1996 ran on pp. 92-93 an article covering the Amherst show "1996 DCC Blowout", that points out that in fact the product Novosel disclosed in February 1996 did not integrate motor control capability.

Novosel teaches in '004 the use of a Yamaha YM3812 integrated circuit as a digital sound generator that is followed by a YM3014 Digital to Analog Converter, or DAC, and that digitization, compression and voice-synthesis are used to convert original sound recordings into data stored in an EEPROM sound storage device that is then suitable for playback. The Yamaha device uses a well-known oscillator-based Frequency Modulation synthesis technique and is employed in most sound cards on the IBM PC's and compatibles, or sound cards like the "Sound Blaster", "AdLib" and others. However, Novosel fails to teach an operative method of converting general locomotive or railroad sound recordings into digital data suitable to drive the Yamaha YM3812 device. In fact, the best approximation would be to make the Yamaha device operate as e.g. a MIDI synthesizer with multiple FM "voices", which do not sound like any locomotive or real world sound recordings, but would render the sounds as an approximation similar to a MOOG keyboard type synthesizer. Thus the Novosel embodiment and teaching fails to provide enough information on algorithms and procedures needed to yield an operating digital sound generator, as claimed, that is suitable for playing back locomotive or model railroad sounds.

The DAST analog sound storage chip embodiment taught by Novosel in '004 is capable of storing reasonable quality arbitrary sound recordings, but suffers from the limitation noted by Novosel that it only has a single "voice" or sound channel, whereas a realistic locomotive sound synthesis requires more than one sound channel in operation at the same time. Novosel's "Real Rail Effects" product demonstrated at the Amherst show at the same time as the Soundtraxx DSD2408 in February 1996, was based on the analog DAST device.

Additionally, Novosel fails to teach or anticipate in '004 the capability of decoder downloadable sound files in for example the popular windows ".wav" format, and that these downloaded sounds can be sequenced by a modifiable control data block or file.

The Soundtraxx DSD2048 is a sound decoder that operates on NMRA DCC track control signals with digitally stored sound waveform fragments, using a parallel DAC such as an Analog Devices AD574 device to convert digital data from the sequenced sound fragments into a signal that can be amplified and then drive a speaker. The Soundtraxx device does not need the extra complexity of compressed or companded sound information, or voice synthesis to store sound data in an onboard Flash memory storage device taught by Novosel. The Soundtraxx DSD2048 also demonstrates multiple digital "voices" or simultaneous sound generator channels that are digitally mixed and then conveyed to a single speaker. Thus the prior art demonstrated and operating before Novosel, included digital "multi-voice" sound generation that is responsive to the locomotive speed and state, motor control and function control of e.g. lights and special effects, and is in every respect a superior and operative technology.

In early 1999 ESU GmbH demonstrated a DCC compatible sound decoder that allowed the user to download to the decoder in the locomotive customizable sound fragments and a control sequencing scheme from a recorded computer wave sound file (file type ".wav", etc), CD or the Internet via the track. Information can also be uploaded from the decoder and sent via the Internet or other means for Customer Service use. The predefined operating state changes of the ESU decoder allowed the user to custom configure these looped sound fragments for steam chuffs (or diesel prime mover) when the decoder changes from accelerating under load, running steadily and decelerating with lighter load. For diesels, the prime mover pitch and volume are modulated based on throttle demand, and unique startup and shutdown sounds are also part of the sound-sequencing scheme. Note that the ESU decoder allows the decoder set up to be modified or downloaded into Flash or EEPROM memory when the locomotive is sitting on a programming track, so that it does not need to be removed to be set up. In contrast to the Soundtraxx AD574 DAC means to convert digital sound data to an analog signal to be amplified on to the speaker, the ESU art employs a Pulse Width Modulation (PWM) method with a following low-pass filter to perform this function. This is a more cost effective and compact art.

This was a big improvement over the Soundtraxx digital sound art, in that any ESU decoder stocked by a retail shop could be customized and downloaded in about 15 minutes to any of the many available locomotive sound schemes by simply hooking it up to a sound programmer. This allows a reduction in the number of decoder retail SKU's or part numbers that need to be stocked by retailers. The Soundtraxx units have dozens of sound variations predefined by the manufacturer, and so all these expensive decoder variations have to be stocked if rapid customer satisfaction is desired.

The original ESU control file that regulates sound sequencing choices that underlay the state machine that controls sound generation process were somewhat limited, and only two "voices" were generated at the same time, so in 2004 ESU introduced their version 3 decoders that allow more voices and have a more complex state machine to define the control of sound sequencing and more user configuration choices. In the ESU art this control file is a compilation of encoded binary data that is proprietary and trade secret. The ESU control file is encoded information for a state machine that some users have been able to partially decode and post some conclusions on the Internet.

However users cannot fine-tune or adjust major sound control parameters beyond the limited set of adjustments provided in the ESU programming and set up software, so in essence the heart of the ESU product capability is shielded from adaptation by a user wishing to modify the sound generator beyond the preset capabilities. This means that it is not possible to have a universal sound generator or user definable capabilities because the native processing capability of the sound generator is not fully accessible and is lacking in key capabilities.

Severson in U.S. Pat. No. 5,832,431 teaches a sound technology employing 'pseudo-random' or 'random' techniques to loop a limited set of digitally stored sound fragments so as to be perceived as playing in a non-repetitive manner. Additionally Severson '431 suggests the use of a simple "FORTRAN-like" language for the 'random' control sequencing of sound fragments. In the model railroad context of mimicking the sounds of parts of a full-scale railroad, the Severson '431 concept of random sounds in not very useful. In fact the physics of the operations of a railroad is in fact not random, and the sound sequences and noises are in fact linked and directly correlated to actions taken by workers on a railroad or physical characteristics and processes of the railroad equipment. For example, the rail joiner "clickety-clack" sound is wholly related to rolling-stock speeds, axle counts, locations of rail joints and the deterministic routes taken by trains etc., moving on a railroad. Horn sounds and bell ringing are the results of engineers following the railroad rule-book requirements, such as horn blasts approaching grade crossings and ringing the locomotive bell when moving within the limits of a yard.

Even the prime-mover sounds of for example a diesel engine are not 'random', but strongly and directly correlated to a physical process. As a diesel engine operates, one of the strongest cyclic noises is the crank-shaft rate repetitive noises such as; tappets, imbalance vibrations, engine cylinder firing cadence that then has an overlay of exhaust and/or supercharger noises. At idle, the diesel exhaust noise is at a lower level, so one may start to hear the underlying 'hunting' of the crank-shaft speed due to the finite diesel fuel governor control response and delay, and this is accentuated when the load on the diesel changes such as when the air compressor operates.

The air compressor is primarily used for the train brake systems and it also does not come on at 'random' times. Air compressor cycling is exactly defined by an air pressure-sensor detecting that air consumption from the reservoir due to braking and any leaks has reached a lower pressure limit. Thus air compressor sounds are triggered or governed by the work the locomotive and train may be performing under the control of the train engineer and conductor and the state of maintenance of the equipment. Certainly none of this is 'random'. So in fact a 'random' model is inadequate to describe and control sound sequences a real railroad or a model railroad sound generator, when the sounds are truly correlated with actions commanded by operators, conductors or engineers within a scheduled work rhythm.

Some sound events that are directly correlated to current, actions, such as a diesel idle being defined by an engineer choosing low throttle setting and the traction motors not engaged, may still be further modified by other influences that appear to 'scatter' the nature of the sounds. For this diesel idle example, the 'scatter' of the engine hunting or even surging while at idle is directly related to the; maintenance, immediate and long term history of the locomotive, including the lube oil lubricity and viscosity, engine wear and temperature and governor settings. Mechanical fuel governors need a finite engine speed or load change before they automatically modify the fuel flow injected into each cylinder. The energy or 'cetane rating' of diesel fuels also changes with age and batches, so the governor flow rates are perturbed simply when older fuel is used, etc. So a 'scatter' mechanism is distinctly not 'random', in the context of this invention, but is directly related to a knowable physical effect that can be predicted and modeled to any arbitrary precision with one or more contributing phenomena. Once a physical phenomena is characterized, then the related sounds can be created and modified so that they follow the defined scattering mechanism without requiring the concept of random or pseudo-random processes or Gaussian distributions etc., which are not accurate sound predictors and thus inferior for this application. The renowned National Institute of Standards and Technology (NIST) teaches in a published technical reference:

http://www.itl.nist.gov/div898/handbook/eda/section3/scatterp.htm that a process that is considered 'scattered' shows " . . . non-random structure." in associations and causality of events.

All this points out that the art taught by Severson '431 may be useful for synthesizing continuous pink noises of an e.g. waterfall or waves on a seashore beach, but is not realistic for a working railroad sound simulation because fundamentally the vast bulk of sounds are directly related and correlated to human activities and equipment history not, 'random' events.

Interestingly on a model railroad, if a human can control the locomotives and any animation of the layout, then we have an exact model and trigger for sound generation and synthesis, since a human activity fundamentally lies at the basis of all the resulting sounds, just as in the prototype or real railroad equipment.

The language idea suggested by Severson '431 for defining sound sequencing algorithms has merit, but useful extensions and new concepts to provide users convenient or straightforward access to this capability are not taught or claimed. In fact model railroad sound decoders and generators from QSI Industries of Portland Oreg., that employ aspects of Severson '431 art are not sound downloadable and cannot have their sound sequencing algorithms modified by an end user, except for a limited set a adjustments allowed by predefined NMRA CV programming. These QSI decoders may have the decoder software, sound control software and/or sound files changed, since they are resident in a socketed Flash memory chip. However this is not state of the art, and means that the locomotive and static sensitive decoder must be opened up and worked on to upgrade or change the sound effects, or even fix software errors or 'bugs'. QSI does not provide the information and examples for end users to generate their own sounds and control sequencing algorithms, so like the Soundtraxx units, users are limited to what the manufacturer explicitly provides.

The prior art does not provide for a sound generator or decoder that is fully customizable and downloadable by the end user. This lack of end user programmability of the sound sequencing and fine control of the sound sequences is not addressed by the prior art, and only inadequate or crude mechanisms have been provided for the user to modify sound generation. For example on ESU and Soundtraxx decoders it is possible to program NMRA Configuration Variables (CV's) to adjust the engine speed responses, volume levels etc, but not allow a dynamic change of throttle set points for e.g. diesel notching or governor set points to be changed by conditional user input to such items as train length and weight etc. To allow more complex and even user definable capabilities, a new art is required.

The goal of all these technologies is to create sound generators or decoders that are adaptable to the desired and arbitrary sound characteristics defined by a user. To be maximally useful and customizable, these units must be downloadable and user configurable for all the sounds and sequencing algorithms.

The provision of a capability that provides user selectable, editable and downloadable sounds and user definition and configuration of sequencing algorithms, without the aforementioned limitations of prior art, is a valuable addition to and improvement over the prior art of model railroad sound generation.

SUMMARY OF THE INVENTION

The provision of sound fragments that are user selectable, editable and then downloadable for example from a personal computer (or PC) running appropriate software is a prior art. The addition of a control file of state machine definitions then allows a user to make some configuration adjustments within the scope of the control authority of the control state machine of the decoder. For this discussion the term sound decoder is taken to mean or read as both a device to be installed in a locomotive or be used as a sound generator in some other manner around the layout.

The prior art does not encourage or in fact even allow the end user access to the core of the sound-sequencing algorithms. To overcome these prior-art limitations, Digitrax Inc. of Norcross Ga., has introduced user downloadable sound generators and decoders that employ the new art of this invention of a user-defined sound generation capability created within a proprietary and novel Sound Definition Language. This new technology is also copyrighted but published and supplied within a single user no-fee limited non-commercial personal-use license for customers who purchase Digitrax "SoundFX" devices employing this invention. (This is similar to the way that; books, movie DVD's, PC software and hardware and other intellectual property are licensed and sold).

User configurability comes from two primary aspects of the products' downloadable capability.

(a) The decoder may be downloaded in its entirety with any complete sound project that encapsulates both the required encoded sound fragments and a sound sequencer control file that will create a complete and operating sound scheme that can change a decoder for example; from a steam locomotive to a diesel scheme in about 30 seconds of programming on a suitable sound programmer means such as a Digitrax PR2 Programmer controlled by the Digitrax "SoundLoader" software program means. This means a retailer or user is never stuck with a fixed capability sound device. This corresponds with prior art.

(b) For the more demanding user the published baseline sound sequencer control file may also be modified within the rich set of capabilities of the Sound Definition Language, and this new capability file may then be loaded to a sound generator to provide a completely different sound sequencer algorithm and sound scheme, even if the encoded sound fragments are not also changed. For Digitrax products the sound sequencer control file that is an output result from the Sound Definition Language (SDL) evaluation is termed a sound definition file or SDF. This SDF file result is typically a binary data file that encodes the desired arrangement of sound sequencing control data encoded in the original source data processed by the SDL evaluation means.

A further improvement over the prior art is to also allow the sound sequencer control file or SDF to contain more than one scheme that may then be user selected at any time during operation. This provides the capability of a significant and user defined adjustability to be executed.

This new capability also allows the benefit of a retailer stocking a single SKU sound decoder that has more than one selectable sound scheme combined inside, such as; steam, diesel and electric sound schemes. Here a bell sound-fragment and other common sounds such as coupler and brake sounds and different horns are shared as needed among the user selectable schemes, lowering the needed total sound fragments. Once purchased the user can simply select the desired scheme, and the decoder may be changed between types of locomotives without the requirement of a sound programmer. For the more discerning user the whole combined multiple scheme may also be reprogrammed or overwritten with a more specialized and complex single locomotive scheme at any later date, and then original multiple-locomotive scheme may even be restored.

The provision of a Sound Definition Language requires a lot more capability than would be suggested simply by being able to perform for example any logical programming task that a well known 'Alan Turing' synthesized; store, move and recall machine may do.

Severson '431 teaches "GoTo", "If" and "PlayRecord" instructions with associated arguments and parameters to provide a random sound record sequencing line by line, or an 'inline' and single thread program. (as opposed to an arrayed scalar or vector type, multi-threaded or DSP algorithm). This will provide a minimum action, decision and branch control mechanism to provide for the development of a random sound sequencing control algorithm. Severson '431 fails to teach an actual operative implementation and encoding of the data to reify the concept, and particularly does not teach or allow for the end user to have access to this "FORTRAN like" or object-oriented language, and this limitation is consistent with the products like those produced under Severson '431, such as locomotive sound decoders from QSI Industries, i.e. the sound sequencer cannot be rewritten, or even downloaded by the user.

It is not sufficient or very useful to simply provide the three inline programmatic instructions; "GoTo", "If" and "PlayRecord" as taught by Severson '431.

In particular to create an advanced and new capability technique it is vital that the sound decoder be able to perform more powerful transformations on the sound fragments themselves, so they are not simply treated as consecutive playable immutable "chunks" of "tape recordings".

The introduction of programmatic inline modifiers that allow user selectable dynamic transformation of the data within a playable fragment is a useful, powerful and novel idea. With this new inline modifiers class of programmatic control, it is possible for example to play a Steam Whistle by first prefixing or executing before the operative "PlayRecord [steam whistle fragment]"

(or in the case of a SDL based program syntax) a

"PLAY [steam whistle fragment]"instruction with a particular modifier that will subsequently cause amplitude and/or pitch modification the real-time playback of just that sound fragment in response to a real time analog "playable whistle" control command. The provision of this examples' type of variable whistle mechanism by the layout control system is taught by Ireland in U.S. Pat. No. 6,747,579. Thus inline modifiers allow a user to control the actual sound generation and sequencing down the most basic level and hence provides the greatest amount of user control and configurability.

This disclosure teaches a whole new range of possible and actual inline modifiers in use in real world products that may also be flexibly changed and configured by users.

The implementation and logical means that implement the fundamental; decoder control software, sound sequencer and sound fragments aspects of a product may be "blurred" by a particular products configuration, but these logical tasks are identifiable and separable at the logical level even if for example they run on a single data processor or microprocessor.

For a product based on the SDL approach of this invention it may be unwise for the user definable capabilities to have any large influence or modification of the basic decoder control software such as motor control or decoding of commands from the system, so if there is a programmatic user error, at least the locomotive will be controllable even if the sound is wrong, since provisions are made to mute the sound generation.

With this caution it now reasonable for the user to have complete access to the inherent sound sequencer logic and control mechanisms and also sound fragments, that are then operated by the user provided SDF to create the sound scheme. This is a novel and valuable capability that results from the ability to download user configured, generated and provided data that is then coupled with unfettered access to the sound generation means. This is distinct from for example the ESU approach, where the user has only got access to the manufacturers limited and presented configuration interface and state machine choices and not the underlying and fundamental mechanisms allowing sound to be generated and modified.

An inline software or language approach is distinct from a state-machine method in that the active instructions assembled to create inline coded software encode their action based on the consecutive and branched execution order of instructions as they are decoded and executed, and not on some additional external relationships or hierarchy.

In an encoded state-machine approach the control encoding will appear to be in a; grouped, list, tabular or "spreadsheet" format where the binary data in the table (or similar structure) operates in conjunction with information encoded by the actual position in the table structure to determine meaning, and then be used to form an action or task. Because of the requirement of the pre-existence of the underlying state-machine table structure, this state-machine method is inherently less flexible and expandable than inline software methods and means, although it may be simpler to implement with a graphical user interface (GUI) type configuration interface, since there is an underlying state-machine defined structure that the user may simply be prompted to fill-out or modify.

With a modern layout control system such as NMRA DCC, the user can have up to 29 binary selectable Function Key commands, multiple analog control channels, up to 64,000 or more binary state control functions, and locomotive speed and control available as potential human generated state and trigger conditions for each locomotive or device on the layout. This provides a very rich set of choices and sound variations and logic. So with this overwhelming set of configurations, types of layout sound and desired customization for each layout it is valuable to put the choices of sound schemes and control logic directly in the hands of the user as provided for in this invention, so as not to impede the imagination and creativity of the user.

Since one or more attached PC's or remote interne connected devices or other controlling devices can be added to the control system and be configured to control routes, signals and any other devices on the layout, these also become potential initiators of sound actions much the same as humans, and even though they can for example provide layout automation and control, they also are not required to be considered random action generators.

Powerful extensions of this user created and downloaded SDF file capability and instructions include; the provision of mathematical and logical user work registers accessible to the user for inclusion in the sound program logic, configurable scatter generators with selectable driving parameters of: time, speed, load, distance, etc. that can trigger sound events, tasks and generate further working parameters, and even trigger whole other sound tasks and cascaded chains of sound events. This list of novel new capabilities in not exhaustive but is indicative of the new tools provided by this invention, and many new capabilities are being added continually that are formed with the methods taught herein and hence fall within the scope of this invention.

Note that almost all sounds of interest that are generated are in response to a human activity, as noted earlier. So, most sound start points in time are logically defined by a trigger event or condition. This begins a chain of sound fragment playback and subsequent modification, even if the resulting sounds are persistent or looped. Other sounds such as ambient country and bird sounds or city, industrial and traffic sounds etc. can be simply generated in time with a mix of suitable scatter generator parameters that respond to e.g. seasons, phase of the moon or diurnal rhythm as discussed before, without any need for unrealistic 'random' sequences.

A useful added capability is for a limited capability of the SDF logic to control some of the physical actions of the logically separate decoder section, for example it may control a MOTOR_RUN flag bit that then allows the SDF sound program to optionally interlock the motor operation performed by the decoder control software logical section and keep the locomotive from moving until it is actually selected for control and has the diesel engine startup sounds and sequence completed. This provides a degree of operating realism, and is simply a combination of a few user-selected commands available to be inserted (or deleted) in the user created SDF, and not predetermined invariably or inflexibly by the manufacturer.

The paradigm of using a sequenced series of powerful instructions is common and valid way to control modern devices and products. In this invention the actual commands and the ability of the user to have unfettered access is paramount.

A further improvement is allowing the playback of a sound fragment that is optionally being acted upon by an inline modifier to be further controlled such that the sound is "looped" or repeated and that this looping action can be selectively controlled by another control parameter. This inherent looping and conditional loop-break capability along with scatter generators permits a realistic variation of playback, which allows a whole new range of sound control and generation options.

A horn sustain segment may be looped optionally and immediately terminated at the occurrence of a selectable conditional break parameter (instead of completing the current looped fragment), so to appear more immediately responsive to the user when releasing e.g. the F2 or other horn function key that has triggered the horn sound sequence. Contrary to the teaching of Severson '431, in this situation it is possible to break or end most looped sounds and transition to a following e.g. sound decay fragment, since most physical processes become discontinuous at the transition between modes (here the abrupt closing of the air control valve to the horn chimes) and so the human ear typically cannot easily distinguish a high-slope or low slope mismatch that may not be completely ideal. It simply is not noticeable in most cases with such a brief transient. It is also possible to add a further option that the loop-break management logic at the lowest digital sound sample level subsequently operates at a pre-selected zero-crossing and/or slope transition criteria so the exact changeover to the next queued sound fragment is closer to ideal.

Here the horn sound end is in fact not random since it is result of a human action, releasing the horn toggle or valve. The sustain or looped section of a horn sequence can also employ a modifier that is based on scatter, since the air pressure and chime contributions change slightly over time. Here the modulation of pitch or amplitude may be a tremolo or slow drop of pitch and level over the horn on duration that is selectable using an inline modifier with a suitable scatter generator.

It is realistic and sensible to synthesize an e.g. diesel idling or running sound that may "hunt" by replaying a looped sound fragment with slight amplitude and pitch modifications based at least some recent and long term history. This is not 'random' and is in fact a very realistic way to blur looping sound fragments since they match the real world configurations of possible engine performance.

The ability to perform a decision based on current sound control states or user controlled function commands also allows the capability of further enriching the logic tree that enables more complex conditional decoding of other sound function control inputs or states beyond one level. For example the sound of a steam dynamo is automatically selected and looped running for a Soundtraxx or QSI decoder when the Function 0, or Light function, is turned on by the user.

In QSI decoders the zero-speed or neutral state and current locomotive direction can serve as a selecting device to change the meaning of a sound function control, such as the Function F6 key being use to select diesel startup when the locomotive is stopped and then control the Doppler sound effect when the locomotive is moving in forward or reverse.

However, this art does not teach that function control key can be used to further qualify or modify another function key or sound scheme action.

In this novel configuration another key or "master" key such as F10 could be used to reconfigure any number of other function keys and hence act like a "shift key" to expand to otherwise unavailable key combinations for controlling additional unique sound sequences and logic on keyboards with a finite number of keys. An example would be to use the F10 function key ON to select a diesel sound "notching" (change of governor level) to be now manually set by the F6 key for engine speed higher and F7 key for engine speed lower and not the user commanded throttle speed. The F10 OFF state would then return the standard F6/F7 function key usages, and the engine notching effect would revert to automatic control by user selected speed knob or device. This expansion matrix may be expanded to more than one level of input in a AND/OR logic tree for arbitrary complexity and combinations. This configurability is in the SDF, not the user control device.

This new configuration is particularly useful because the function keys are immediately and conveniently available for real time control on most user control devices such as hand throttles. Obviously one can arrange this new selection method for reconfiguring functions by allowing the user to program a control CV or even download a whole new SDF, but these are cumbersome and not as responsive as direct function control modification.

The configuration and programming of a sound decoder has at least three components described earlier, one for each logical part of the product that is the minimum to create an operable sound decoder unit.

For the decoder control software it is valuable to be able to reload this operating software so improvements and enhancements may be disseminated. To do this there is a small stable boot-loader section in the original decoder control software that is capable of identifying a valid new software update and then performing an Initial Program Load (IPL) of this new software content. Since this decoder control software is strictly proprietary and must be very accurate to ensure no mal-operation that may cause hardware damage to the decoder, it is useful for the new IPL software to be encrypted so only a proper target sound decoder will be able to accept it and validate it and use it.

This has a twofold benefit. It ensures only an authorized and proper device may be able to use this IPL and ensures an unambiguous verification of the IPL contents because known predefined data signature sections are embedded in the cipher-text portions and the authorization to accept (or alternately to spoof) the IPL is not corruptible, and it ensures that the IPL code may be disseminated from e.g. a web-site without compromising a manufacturers intellectual property and product development investment. Part of the IPL process set up can include clear text or even human recognizable data as the first stage of validation, but an encrypted validation phase in vital to ensure decoder integrity and safety. For security, only the manufacturer and secure portions of the decoder boot-loader need know the unique encryption key to be used for any product IPL. The validation by these additional steps does not mean that the communication links carrying the data from the original source such as a web site or a data file from a file storage device do not also include any of the numerous well-known data integrity verification means to ensure quality of data transfer in each step of the data downloading process.

The sound sequencer logical part is updated with new data to allow the desired sound sequencing and this data does not need encryption since it is user modifiable, and any malfunction is not likely to cause physical harm to the sound decoder or generator. The sound fragments are typically the largest data sections and may be several megabytes of data in extent. These also do not need encryption for downloading since they are editable and modifiable by the user and any errors will not damage the decoder. Note that the lack of either sound sequencer or sound fragments will not stop the decoder from being operable with non-sound capabilities, so these two data components are distinctly different to the decoder control software in a fundamental way.

For the programming of the potentially large sound files and a number of different data types, it is important to include novel and strong synchronization methods in the hardware and physical link between the hardware programming device, e.g. a Digitrax PR2 sound programmer, and the sound generator or decoder. This is because the decoder control software, sound sequencer and sound fragments all need to receive data for configuration, and the programming device will have to switch unambiguously between many types of encoding modes and data types. This mode-synchronizing method is not needed between the e.g. PR2 sound programmer and the host computer or PC running the sound updating or user configuration software, since the communications interface here is better defined between software and a communications channel and does not need to change modes, which is best kept partitioned at the hardware device level.

With the prevalence of computer viruses, 'Trojan horses' and other malicious software it is also valuable to ensure that the download path from; the SDL language, programmer interface, Programmer hardware and track connection to the decoder used for programming have some new means for verifying SDF and sound fragment integrity. This verification means is intended to ensure that the downloading process is controlled by a trusted program and process, so malicious, incompetent and disturbing actions are limited.

Prior art decoders often add capacitors or batteries for energy storage in the track pickup power supply means to ensure that power interruptions do not cause problems with loss of decoder operation and more importantly that sounds do not get distorted or cut-off randomly. These mechanisms may cause power related problems on digitally controlled layouts, so improvements in energy management means that solve these problems are valuable.

Thus, the cited examples of known prior art are clearly distinguished from and have less capability than this invention. This invention is not intended to be solely limited to a particular track control method or implementation and may be formed by those skilled in the art of electronic circuit design, control software design, and software development using the methods presented herein.

ATTACHED DRAWINGS: 5 Sheets

FIG. 1 details an example of a prior art sound programmer user interface for configuring sound sequencing.

FIG. 2 details an example of a prior art sound programmer user interface for configuring random sounds.

FIG. 3 details a preferred embodiment sound programmer user interface for configuring sound decoders.

FIG. 4 details the elements of a sound downloading process.

FIG. 5 details waveform transitions in coding methods of download data.

FIG. 6 details an embodiment of an optimized energy management means.

DETAILED DESCRIPTION OF INVENTION

FIG. 1 depicts a configuration screen from a prior art ESU version 2.5.6 programmer software running under the Windows operating system and used for downloading and configuring their proprietary LokSound sound decoders. Item 1 represents the locomotive stationary or idle state when the "sound schedule" or sound scheme editing capability is selected. The balance of small boxes in the main software window of FIG. 1 represent a number of other speed states that are part of a state-machine sound scheme that may be set up by the user to define sounds to playback at each decoder state. Item 2 indicates a state transition from a mute (M) state to muted-stationary state (MS), and the arrow indicates the direction and reason for the state change.

The example selected is an ESU sound project "Universal FP7" diesel scheme with three major state changes in the prime mover speed states. The prime mover sounds such as the diesel engine or steam exhaust chuff sounds are usually the most striking feature of a working locomotive and railroad so are the most important state driven sounds, and these commonly are related to operating speed. The balance of sounds that enrich the operating sound scheme are related to other events such as bells, horns, whistles, air compressors, dynamos, brakes and similar that are triggered at various points in the locomotives work schedule. With digital command control user actions result in encoded action commands that then influence sound generation.

The boxes labeled A1 and A2 are accelerating states and D1 and D2 are decelerating states, and CX, item 5 is a coasting phase for this ESU predefined sound scheme. This state diagram may be expanded to more acceleration and deceleration states, but is fundamentally limited in the way a user can define decoder states and sound sequences; since only the manufacturer can set up and adjust the underlying nature and interrelationships of the state-machine structure, with the predefined adjustment parameters the manufacturer also defines. The user can only add sounds at each state and transition between states from a drop-down or object oriented drag-and-drop sound selection list, and adjust the speed criteria that determine state changes. Item 3 shows a selectable value that ESU terms a "barrier" that is used to control the speed at which the limited number of states may transition. Item 4 represents what ESU terms a "threshold" that is also used to define a speed at which state changes may happen. Thus ESU sets up this state-machine to only be responsive to a speed parameter. This is unlike the ability of the new art of this invention that provides for prime mover sound sequencing based on any parameter and even a logical combination or synthesis of more than one parameter.

This ESU prior art is a glorified tape-player style sequencing machine that can splice a number of sounds from each operating phase of a prime mover and replay it with a limited set of choices predefined by a state-machine implementation. The ESU ability to repeat a sound, change its relative volume or to pitch modify based on speed may be selected as one-dimensional or limited single adjustment choices per effect for each sound fragment, but there are no multi-parameter (or multi-dimensional) and configurable modifier or scatter mechanisms and means that may be employed in any combination to modify the sound fragment playback logic. The GUI used by ESU sound programmer software in fact disguises, predefines and limits the visibility of the underlying sound generation logic capabilities and hence controllability and configurability by the user. This does not mean a properly configured GUI cannot be useful and convenient for a user, but if the user control choices are limited or prejudiced in any way then the implementation does not allow for the maximum desired user customization capability.

Additionally these limited ESU adjustments are fixed within an inflexible manufacturer predefined prior art state-machine control method which is a stark contrast to a flexible new art language based means that allows the user to combine powerful new instruction means in any desired order to synthesize results of any arbitrary complexity.

Note that other conventional aspects of decoders such as function and motor control may be configured within the other menus of the ESU software of FIGS. 1 and 2, but the NMRA CV's they use for configuration are not user definable but in fact are predefined by ESU for all cases where function has not been pre-ordained by NMRA community common usage.

In contrast to the prior art, a true programming language method and means with inline modifiers accessible to the user, allows the state information to add any type of logic and condition the user desires at any event or trigger condition(s) and to then generate any simultaneous modifier tasks to create a flexible user-definable sound stream.

For example, using a capable sound definition language, when locomotive direction is commanded to change, it is possible to conditionally evaluate the peak-speed seen in the last direction to discriminate if the unit has been at yard switching speed or mainline speed. At or just before the point of actual direction change a brake sound fragment may be played along with a subsequent coupler-crash sound to mimic a yard shunting or switching operation. The conditional last peak-speed evaluation allows the sound sequence to be differentiated automatically between different operating modes, so that if yard switching is performed the brake/coupler sound is automatic and if the operation is inferred on the mainline (i.e. last peak-speed exceeded a set threshold) a lower volume or no brake/coupler sound is played. Thus with a few simple commands a user can configure a complex and realistic conditional logic sound task that a manufacturer may not have envisaged or provided for in a prior art simple state-machine implementation of sound sequencing logic. The ability to have an unconstrained combination of conditional logic sequencing decisions and subsequent rich set of modifiable sound playback parameters distinguishes this new art from the limited user-configurability manufacturer-predefined and constrained prior art.

FIG. 2 shows the ESU "random sounds" configuration screen or menu this is one of a number of GUI choices to configure an ESU sound decoder. Item 6 allows selection for this "random sounds" screen shown, and item 7 allows another screen of limited user sound choices similar to "random sounds". Item 8 represents one of a fixed number of idle state-machine choices for up to only three consecutive random sounds to be "inserted" or controlled from item 9.

Item 9 is the expansion of the sounds chosen to be active during item 8 "idle1" state, and shows a single sound choice, "pressluft.wav", selected from a list of wave fragments, item 11. Item 10 is a further GUI menu choice of manufacturer-predefined capability for configuring the replay of the "pressluft.wav" sound when the random sounds "idle1 " state is active. ESU provides a minimal set of predefined user choices for this playback such as; looping or repeat count, volume, if engine sound is needed, priority, delay and an enable function output.

All these ESU state-machine fragment modifiers are limited in scope and dimension and do not provide comprehensive control of fragment playback with more than one parameter or control effect, or allow the user to in fact define the environment.

The item 7 set of "user definable" sounds provides a similar set of 16 "sound slots" that the user has the same limited set of choices as the "random sounds" screen. This has the same state-machine limitations as "random sounds" and the user cannot; configure more than three sounds per event, expand the number of events or the logic that triggers or causes the event to occur, or combine or synthesize a more complex event or sound sequence from simpler triggers and states.

Preferred Embodiment of a Sound Definition Language:

The 10 sheets of attached Listing 1 show a complete example of a user source file named "EVO_5741.asm" in a symbolic SDL text format that may be processed to create a functional SDF file that contains information or data suitable for download to a sound decoder for the subsequent control of sound generation. This example is taken from parts of an actual working commercial product, and this example may be processed by a suitable Macro-Assembler that will produce a binary SDF file. Documentation for this example is also available on the software section of the www.digitrax.com website which also provides all the collateral material for users to get complete sound projects, and files to allow generation of custom sound schemes and SDF's.

For this discussion the following line numbers refer to line numbers in Listing 1, which is provided as a complete stand-alone printed 10-page entity to be included within the body of this specification.

Lines 1 and 2 of Listing 1 set up this example source file for processing, by defining the inclusion of two related data files that have defined structures and data, and this file inclusion method is well known to those skilled in the art of assembly code software and program development. The file Snd_cmd.INC defines all the structures and data needed to encode the binary bit patterns of the Sound Definition Language (SDL) instructions, and the SND_MACS.INC file is needed to allow a Macro-Assembler to perform a macro cross-assembly using a Macro-Assembler that was not originally designed to comprehend the SDL format. An example of a suitable Macro-Assembler would be the MPASM 3.0 assembler available from the development-tool section of the www.microchip.com web site. This MPASM Macro-Assembler may be run in the command line mode or from within the MPLAB Integrated Development Environment in a process well known to software developers.

On line 7 The SKEME_START instruction with associated data argument value of 0 generates binary data that marks a point in the SDF file that allows the location and extraction of the defined sound scheme number 0 when the sound sequencer logic processes the SDF file after it has been stored into an associated decoder SDF Flash or similar data storage memory. A complementary SKEME_END 0 instruction at line 334 allows the total length of scheme 0 to be established without having to search for the scheme end in the SDF data. Lines 337 and 544 define an available second scheme 1, and up to 30 more independent schemes may also be included in any scheme order in the SDF. The operating scheme can be selected in many ways but the most convenient is by using for example a non-volatile NMRA CV60 or similar to select the current scheme. Since CV's can be readily modified while a locomotive is operating on the tracks, it is then possible to dynamically modify the sound logic and decoder response in any manner between any user defined schemes, although the benefit of changing from a diesel scheme like scheme 0 to a steam scheme like scheme 1 may not be readily apparent, except as a parlor trick. Most usefully it is sensible to configure various schemes to provide more elaborate sound schemes for different aspects of the locomotive operation such as switching in the yard, versus mainline operations and conditions of speed and loads. Background sounds and other enrichments may change for example as the time of day, etc. by using dynamic scheme choices.

The SDF implementation logic of this invention also allows more than one SDF file to be downloaded, and the active SDF file can also be selected by the 3 most significant bits of CV60, while the least significant bits of CV60 select the active scheme within the selected SDF file. If there is a problem with missing schemes or SDF's then no sound will be generated but the decoder will still function for motor and light control etc. The SDL definitions allow up to 256 simultaneous sound generating channels or tasks to operate as sound "voices" at the same time. To define a block of consecutive SDL instructions as belonging to a particular channel the CHANNEL_START (number) instruction is used. All instructions following a CHANNEL_START are logically bound into the channel # (number) until another CHANNEL_START instruction is encountered. Lines 10 to 124 define the first sound channel, numbered 1 and intended to contain most of the prime mover continuous or persistent sound sequences. Lines 125 to 274 defines a second sound channel that processes transient or non-persistent sounds like horns etc., and lines 276 to 332 defines a third channel that processes persistent sounds like bells etc.

There is no precedence or significance to the channel order or number, but the consecutive arrangement of instructions within any channel define a user controllable natural priority of sound sequences encoded by any contained instruction groups in the channel. This allows very accurate, powerful and precise user control of sound generation logic.

Since sounds result from trigger events, the SDL prefaces all sound sequences or chains in a channel to begin with an instruction that defines an initiating or trigger condition. Line 15 defines an SDL 'INITIATE_SOUND' instruction with a first selector parameter 'TRIG_SF8' and a second polarity (or sense) qualifier parameter 'NOT_TRIG'. The effect of this symbolic instruction text string in the source code file is to cause the Macro-Assembler to output a defined encoded binary data pattern that encodes an SDL instruction for a trigger condition to be met and made active when a defined 'TRIG_SF8' or F8 function key trigger condition has become NOT true, i.e. this defines the starting point for a sound sequence group of instructions when the F8 function key condition becomes untrue or OFF. All state changes, such as speed, direction, user action function keys, input lines etc., that can have any effect on sound generation or logic are provided with unique trigger codes that the SDF based sound sequencer logic can use to generate a sound scheme of arbitrary complexity and sophistication.

The subsequent line 16 with name-tag MUTE_OFF0 is ignored by the assembler since this is simply a mnemonic named human-readable source line, and then the instruction on line 17 is assembled into binary data.

The line 17 'LOAD_MODIFIER' command has up to four or more following parameters and is a very rich and capable SDL instruction, which also lies at the heart of the inline modifier technique of this invention. The line 17 instruction is one of many defined modifier instruction logic tasks, and the 'MTYPE_WORK_IMMED' variant simply loads the value DEFAULT_GLOBAL_GAIN into a user accessible work register defined as WORK_GLBL_GAIN. The effect of this is to set up the whole decoder master volume to a user-preset value of DEFAULT_GLOBAL_GAIN. Line 19 encodes a SOUND END instruction that terminates the processing of this sound sequence or chain. Note that the instructions triggered by F8 OFF in lines 15 to 19 do not in fact begin any sound fragment playback but are being used to have a profound effect on the sound scheme. The combined effect of lines 15 and 17 is to un-mute the sound or set up a default volume level when the F8 key becomes OFF, since in this scheme 0 the user has configured the F8 function key ON state to be used to mute the decoder sound volume. Lines 22 through 26 perform a sound mute function which is triggered by the TRIG_SF8, NORMAL or function key F8 ON condition, and the line 24 'LOAD_MODIFIER' instruction gets a gain or volume setting value from a user defined Sound-CV SCV_MUTE_VOL (previously user set conveniently to CV135) and puts this into a user accessible work register defined as WORK_GLBL_GAIN. This has the effect of changing the master volume for all the decoder sounds to the new MUTE level that can be significantly lower or even a zero-volume level.

Note that the work register array provided for the user to manipulate has many defined items that control aspects of the real-time operating sound generator functions. This is an additional mechanism that provides full user configurability and control of all key aspects of sound generation and sequencing, unlike prior art. For example the mentioned WORK_GLBL_GAIN work register is referenced as a scaling variable by all algorithms that calculate any sound data contributions to the sound schemes. The defined WORK_PITCH_TRIM work register allows the final playback pitch of the whole sound generator to be modified up or down by about an octave.

The work register WORK_STATUS_BITS has a number of defined control and status bits visible to the user that allow the sound sequencer software to monitor and have a limited interaction with the decoder control software state. For example the sound sequencer software can detect a defined flag bit, named WKSB_DIRNOW_BIT, contained in this work register that indicates the current motor direction, and another flag bit, named WKSB_ANALOG_BIT, indicates if the decoder is on a conventional power or digitally commanded layout. A further bit, named WKSB_RUN_BIT, actually allows the sound sequencer software to command the decoder control software to stop or re-enable the motor.

User access in the new art to any of the sound sequencer low-level functions is provided at the lowest possible task level consistent with reliable sound generation. While this may appear to be an arbitrary manufacturer limit on what a user can configure, it is significantly broader than any user access provided by the prior art, and is distinguished by the fact that it is provided in an explicit and configurable instruction context wherein any lower level task access would jeopardize proper sound generation and impose a great burden on users to be able to understand and control multiple interleaved and overlapping complex data and control operations, when in fact the desired capability is to have most flexible sound sequencing available in a well defined linear programmatic format.

All the WORK registers and all other trigger and other data structures required for a functional SDL means are fully defined in the Snd_cmd.INC file from the Digitrax.com, web site and are also visible in the EVO_5741.1st file that results from the Macro-Assembly of the EVO_5741.asm source file that comprises the bulk of Listing 1.

Prime Mover Sound Schemes:

Lines 113 to 121 defines the scheme 0 sound sequence that runs when a diesel locomotive is stationary at idle with the prime mover running, when TRIG_SND_ACTV is true as a result of the decoder being selected by an operator/engineer. As the last sound sequence of channel 1, it is the lowest priority and runs if no earlier channel 1 sequences are active due to locomotive movement or other prime mover state changes. For finer control three modifiers are used for this sound sequence. Line 120 'LOAD_MODIFIER' of type 'MTYPE_GAIN' is configured to make the diesel idle fragment volume controlled by user defined CV140.

Line 118 'LOAD_MODIFIER' of type 'MTYPE_PITCH' allows the diesel idle fragment to have its pitch modified by the work register 'WORK_NOTCH'. Line 116 'LOAD_MODIFIER' of type 'MTYPE_BLEND' configures the active channel 1 to have a rate-defined blending of pitch and gain/volume when any step changes are made in this channel 1. This is a very powerful and useful inline modifier function that ensures when the user makes gain/volume or pitch changes that the output is smoothly changed at a user defined rate. So, for example if the speed steps up immediately by a notch step, the speaker pitch of the diesel sound fragment will not instantly change, but will smoothly increase over a time to simulate the acceleration of a real diesel under load. This inline modifier allows the use of a small number of looped diesel fragments to realistically synthesize a diesel engine in full range of operations. Once this DIESEL_IDLE1 sound sequence is triggered, the blending, volume and pitch controls are user configured for transitions to other diesel playback sounds. The Blending parameter is set based on the diesel engine power and time-constant characteristics.

Line 121 is actually the "PLAY_END" instruction that plays the required sound fragment defined by the parameter, or "fragment handle", "HNDL_DIESEL_IDLE" and this instruction also has a number of operating modes. The loop-break control parameter "loop_till_init_TRIG" qualified by "loop_INVERT" means that the sound fragment will be looped automatically until the defined loop-break condition is NOT met. In this case this looping condition is true while TRIG_SND_ACTV11 is true, or until the locomotive is not selected active anymore. In this way the diesel idle condition is a fall-back prime mover sound for an active locomotive which has no other diesel speed state running as a higher priority. When a PLAY_END playback completes then the sound sequence is at an end state and no further instruction in that initiated or triggered chain is accessed.

The running state sounds of the diesel, i.e. it is not at zero-speed (idle) and not accelerating or decelerating, is defined by lines 99 to 108. Here we also have three inline modifiers selected before we use the "PLAY_END" instruction on the sound fragment selection "HNDL_DIESEL_RUN". This run sound is looped until the loop-break condition defined here as the initiating trigger "T_SPD_RUN" is not met, or the run state is not active, due to transition to idle or accelerate/decelerate operating phases. The instruction "INITIATE_SOUND" trigger condition on line 101 has two other control qualifiers selected. The "RUN_WHILE_TRIGGER" condition means that the whole sequence of lines 101 to line 108 remains active or persistent while trigger state "T_SPD_RUN" is true and does not simply run once when "T_SPD_RUN" becomes true, as all trigger conditions will act by default. The "ZAP" qualifier ensures that a higher priority sound in this same channel 1 can interrupt this sound fragment at any point in playback and not simply at the end of the current looping fragment playing to the end. The looped running sound will thus be terminated either by the loop-break condition in a playing state or the persistent initiate trigger condition ending, and these are redundant ways to ensure that the run sounds can be switched properly to other diesel operating states. When the switch to other states occur and other sound fragments are selected, a configured active inline modifier "BLEND" will ensure that there is no discontinuous step in pitch or gain/volume of the succeeding sounds.

An important aspect of the diesel speed changes is the WORK_NOTCH register for simulating the 8 notch steps of the US diesel control configurations used to modulate diesel/generator power.

The lines 84, 95 and 107 inline modifier types "MTYPE_PITCH" with an "ANALOG_PITCH_MODIFY+WORK_NOTCH" parameter configures the playback pitch of the following diesel sound fragment to track the WORK_NOTCH work register value, that itself tracks the locomotive throttle setting. This means that the diesel pitch will change in a defined way in steps as the user throttle is increased, and that each step of WORK_NOTCH will be "softened" by the active inline modifier "MTYPE_BLEND" acting on both pitch and gain in a user defined way. The "MTYPE_PITCH" instruction type also has a second control dimension that can select a pre-configured WORK register such as a scatter task to add another input of pitch modulation. His would allow for example some low frequency wander or dither in the engine speed to be introduced as desired to simulate a well worn engine, etc.

The "MTYPE_GAIN" type of inline modifier instruction also has another simultaneous control channel that can select a work register to additionally control gain, beyond user setting via e.g. CV140 and a scaling factor. Note that the inline modifiers are not limited to a prime mover sound channel but are usable and very useful for any sound fragments in any channel or scheme, and allow control in more than a single parameter, variable or 'dimension'.

This is a brief introduction into the rich and complex capabilities of some of the inline modifiers of this invention that provide a powerful means for users to generate sounds in a very versatile and controllable way.

A person skilled in the art of software design and coding can review provided working examples of SDF source files and SDL documentation and hence gain a full understanding of the sophisticated tools that the SDL method provides, along with the ability to modify and examine the sometimes subtle effects of modifications when downloaded into an operating sound decoder employing the art of this invention.

The new art is clearly distinguished from the Novosel '004 prior art since; PCM sound data encoding is used, instead of FM voice synthesis or analog DAST sound means, and a commercially working means is taught that allows an integrated sound generator and motor control to be created that employs a novel SDL configuration method. Additionally, this new art has the ability to be downloaded and flexibly configured by the user and is best implemented using a PWM realized DAC conversion to provide compact and low cost conversion to analog sound. Since the decoder control software already has the ability to decode function commands that are then used to trigger and control sounds it is possible and useful for the decoder hardware to also have function control lines that may be used to control lights and other attached hardware devices such as couplers in any manner desired.

Lines 77 to 85 defines the acceleration phase diesel sounds when the trigger code "T_SPD_ACCEL1" is active and lines 88 to 96 define the deceleration diesel sounds when the trigger code "T_SPD_DECEL1" is active with the same general function as discussed for the run state sound. The priority here becomes; acceleration, deceleration, running and then idle sounds, based on this channel 1 order of diesel sound sequences. Note that the MTYPE_GAIN modifiers are for immediate gains or volume based on the SCV_PRIME_VOLUME (CV140) variable, so that the whole diesel sound scheme in channel 1 tracks this CV140 relative volume setting. An additional second GAIN control dimension is also provided with the "MTYPE_GAIN" instruction and this is an extra gain/volume adjustment that allows the relative GAIN level to be scaled. For example the accelerate phase uses a gain scaling of "SCALE_F" as the highest relative volume since the diesel is working at maximum load in the acceleration phase. These additional aspects of a the inline modifiers for GAIN allow the use of a single working diesel sound fragment to be amplitude modified and pitch "bent" in a realistic manner to provide a working diesel sound scheme. Note that in DC conventional power operation there is no DCC digital speed command present to set the visible current motor PWM in appropriate work registers WORK_NOTCH and WORK_SPEED by the decoder control software. To provide the needed speed and notch information when in DC conventional power the DC track voltage is measured and converted to the equivalent speed command and then the affected work registers are updated so the diesel "notching" effect and inline modifiers will work seamlessly without any change in the SDF structure.

If an exhaustive sound scheme is desired where all sounds and transitions between diesel running states or "notches" have been recorded (and sufficient sound fragment memory is available), it is a simple matter to reconfigure lines 77 to 121 to conditionally select the correct sound fragments based on speed and operating phase, since an additional trigger is provided whenever any speed state changes. The SDL "MASK_COMPARE" instruction may be used then to provide a mathematical test and branch on speed condition to parse any new speed change to begin the correct associated sound fragments. An exhaustive sound encoding is effectively the same strategy ESU uses for their latest generation diesel decoders, albeit realized with a state-machine implementation. An exhaustive diesel sound scheme does not strictly require the notched pitch "bending" possibility of the "MTYPE_PITCH" inline modifier since the diesel engine is recorded at up to 8 of the notched speed settings, but the dithering channel may still be employed.

For completeness, lines 21 through 26 is the logic that starts the decoder Mute condition when TRIG_SF8 is true, or the user Function 8 key is pressed ON. Note that no sounds are played by this configuration sequence that ends with an "END_SOUND" instruction on line 26. The line 24 "LOAD_MODIFIER" instruction also demonstrates the ability to load the WORK_GLOBAL_GAIN register from the mute level control user defined CV, CV135. Although all CV's above e.g. CV130 may ultimately be user defined, it is sensible to follow a convention for a number of common sound CV usages such as volume etc.

Lines 29 through 61 set up the diesel engine startup sounds when the decoder is first selected and introduces several more SDL instructions and capabilities. The "SKIP_ON_TRIGGER" instruction on line 34 allows the user to query the current state of TRIG_SF8 so that if the unit initially encounters F8 =ON=mute then line 36 which sets the un-muted volume level will be skipped to maintain muting. The "DELAY_SOUND" instruction inserts a programmable silent timed pause between a start alarm bell fragment and the following diesel start fragment. The "PLAY" instructions have the same form and effect as the already introduced "PLAY_END" instructions without terminating a sound sequence.

The "MASK_COMPARE" instruction on line 40 allows the user to test the state of the ANALOG status bit in the WORK_STATUS register and allows the engine startup sequence lines 45 to 53 to play only if the track signal is detected as DCC (not analog). Line 59 "MTYPE_WORK_IMMED" is another variation of the inline modifier instructions that performs mathematical and logic functions on work registers, and the encoding shown sets ON the WKS-B_RUN_BIT, which then allows the decoder control software to enable motor control after the diesel has actually "started" as perceived by the user. Note that it is a simple matter to remove this DCC mode motor delay logic and simply allow the motor to run without waiting for the startup sounds by making this flag ON immediately the decoder becomes selected or operative. This flexibility and user choice is not possible with prior art.

This instruction (like several others) have the addition of a mask bit parameter to allow the selective inclusion of any user defined data bits in a byte to be involved in the mathematical or logical operation. Both the "MASK_COMPARE" instruction and the "MTYPE_WORK_IMMED" inline modifier instruction forms may perform maskable mathematical and logical compares that sets a MATH status bit and then allow conditional branching or program flow. The Math and logical capability of the inline modify instructions also allow manipulation of data between any of the work registers for new control logic and constructs. These functions include, logical AND, OR and XOR and ADD as well as an INTEGRATE between limits form. This is a very powerful way to tie together the user-visible state and control information in work registers and sound CV's and then allow the user to write a SDL program that allows a sound scheme of arbitrary complexity with numerous control variables, parameters and inline modifiers.

Scatter Generators:

The prime mover sounds are just a part of the whole locomotive or layout sound schemes. Additional user-commanded sounds or other scattered sounds are also needed to make a realistic sounding scheme. Channel 2 of scheme 0, encoded between lines 125 and 273 includes the transient sounds that can be triggered by a user key press and also by several scatter tasks.

Lines 128 to 136 loads and enables three Scatter tasks using the inline modifier instructions "MTYPE_SCATTER" when the decoder is initially selected and line 130 is triggered by "TRIG_SND_ACTV11". Scatter tasks run autonomously when configured and provide several repeating trigger codes at times encoded by the particular scatter logic loaded and any WORK register or a CV value chosen to be the input parameter for generating scatter, such as WORK_SPEED etc. There are 8 defined scatter tasks and the last four, scatter 4 to scatter 7 also have their state information visible in four user work registers for selectable inclusion into user mathematical, logical or branch actions.

Here Scatter task 0 is a timer for the air-drier pop-off sound rate based on value of CV 145, Scatter task 1 is a slower rate task to trigger the Air Compressor operation correlated to WORK_SPEED and based on CV146, and Scatter 2 is configured to be low rate "sawtooth" to allow a slow dithering scatter choice. These three scatter set up instructions can be placed or triggered in any channel since they do not produce any sounds and only run once at high priority when the decoder is first selected. Their inclusion in channel 2 here was by preference for clarity.

Lines 201 to 208 is the sound sequence that makes use of Scatter task 0 that was configured at decoder selection/startup by the user. This trigger TRIG_SCAT0 conditionally makes the air-drier pop-off sound if TRIG_SF4 or function Key 4 is ON. Note that an inline modifier is used for this sound fragment that sets the volume based on the sound CV SCV_AIR_VOLUME [user defined as CV143] value. The scatter task 0 does not repeat the same each time but is modified by a speed accumulation algorithm as the set up defined.

Lines 210 to 218 is the sound sequence to trigger the transient air-compressor un-loader air blast that occurs at compressor cycle-end based on defined Scatter task 1. Note that this sound is also synchronized to the ending of the persistent air-compressor run sound programmed in channel 3 , or line 299 to 309. When the line 306 "PLAY" instruction ends on the loop-break condition of the initiator TRIG_SCAT1 becoming OFF the line 217, POPOFF sound is simultaneously triggered on channel 2 and the resulting combination sounds like a diesel compressor turning off. Note this is just one combination of instructions that can be set up to synthesize this sound. All the "air" sounds use the "MTYPE_GAIN_IMMED" inline modifier to set their volume to be controlled by SCV_AIR_VOLUME as a feature grouping, and if this were not done any 1035 playback sounds would have the "default" volume and would then be only modified by the Master Volume CV58, and could not be preferentially modified to suit personal taste.

Lines 138 to 143 is an example of another control possibility where an available trigger based on relative distance run (TRIG_DISTANCE) is used to selectively make a "milepost" announcement when the locomotive is moving. This announcement is suppressed if Function key 11 (TRIG_SF11) is OFF, by the action of the SKIP_ON_TRIGGER instruction of line 141. This is provided as an example of using a function control to provide conditional expansion of control. A simple further expansion of this TRIG_DISTANCE trigger would be for the user to integrate or count these trigger events, and at CV defined threshold issue a "Fuel low" or "coal low" message or similar sound fragment that would be a maintenance item related to distance moved.

Selectable and Playable Horns:

Lines 146 to 175 provides a good example of using a sound CV, CV_HORN_SELECT [CV150], to allow the user to choose one of three diesel horn modes when the user function key 2, TRIG_SF2 is operated ON. The "MASK_COMPARE" instruction at line 151 branches to line 154 and a simple horn sequence when CV150=00 (the CV default value). Note the use of the loop-break modifier of "loop_till_F2" and "loop_INVERT" at line156 to terminate the "sustain" phase of this horn version controlled by F2 OFF. This is needed since when the F2 is released OFF the sustain ends and the ending or "decay" phase fragment at line 157 still must be played. If the sequence ending were alternately controlled by an added initiate parameter in line 148 this level of control would not be possible.

If CV150 has a stored value 01 then line 164 or the "playable horn" sequence is selected to operate on the F2 key. This is a good example of using the novel inline modifier "MTYPE_GAIN" with analog variable control channel data decoded into a user visible work register WORK_ACHNL_7F to vary the horn blow gain/volume, based on the user key pressure on the F2 function key, which is mapped to analog channel#7F by Digitrax DT400 throttles. Note that if no analog data is seen from the throttle the F2/horn will still work albeit at a slightly lower volume. It is also possible to add a "MTYPE_PITCH" modifier instruction controlled by the analog channel#7F, but this is not present in this horn version since diesel air-horns have very little pitch change with applied air pressure, unlike steam whistles. Note that it is a straightforward matter to implement an additional and selectable horn "sustain" phase with an instruction test and branch loop instead of a single loop-break "PLAY" instruction. Here the user SDF program can continuously test the horn pressure in WORK_ACHNL_7F and change at a desired threshold between two looping play fragments with different volumes and chimes or notes. A suitable rate set up for a gain BLEND on this channel would allow a smooth transition to and from the louder horn fragment. This would be prototypical for many diesel air-horns that play a fixed set of horn flutes or chimes up to a certain air pressure then add more chimes (and volume and distortion) above a critical point. This programmatic capability for a user to configure air-horns in a number of modes and levels of realism has not been possible before the new art of this invention.

With the addition of the single inline modifier instruction at line 165 the horn function has been greatly accentuated and upgraded to a new level of capability. It would be possible to alternately put a "BRANCH_TO" HORN0 [line 154] instruction at line 167 and compact and delete the following three instructions, since this branch command would execute the same common sequence after having loaded the desired inline modifier instruction at line 165.

Lines 171 to 175 is the F2 sequence activated if CV150 has neither 00 or 01 data value, and is simply a version of a different horn recording HNDL_HORN1_START etc. provided for variety. Thus lines 145 to 175 teach useful and practical combinations of the new art to provide a more sophisticated user configurable and customizable sound decoder.

Automated Coupler Sounds:

Lines 178 to 198 animate a version of automatic coupler sounds that occurs when the trigger TRIG_DIRNOW_CHNG occurs upon a decoder motor direction change. Line 183 uses a "MASK_COMPARE" instruction to check if the direction change has occurred while the last WORK_PEAK work register value is still zero—i.e. no speed/movement since last direction change. If this is the case we simply exit the sequence by clearing WORK_PEAK again. This also occurs if TRIG_SF3 is OFF, since F3 is defined to control the coupler-clank sound when ON.

Line 189 is evaluated when F3 is ON and we have a direction change with a non-zero peak speed in the other direction. We use a "MASK_COMPARE" instruction to see if the WORK_PEAK work register is above or below a threshold speed in a user selected sound CV, CV151. If the peak speed work register is below this threshold, then a brake squeal and then a coupler-clank sound is played, then the peak speed is again cleared so as to track the next peak speed. This is one way to provide semi-automatic task related sounds, since yard switching has many low speed direction changes. Other methods may be envisaged or used within the scope of the instructions and methods presented herein to give some scatter or history-based logic mechanisms at different speeds and other states to trip sounds that enrich the operations, and that are not random in the sense of the Severson '431 art.

Lines 221 to 223 simply plays a single coupler clank sound irrespective of the automated coupler clank logic and F3 needs to remain on for the automated clank to occur. Lines 227 to 233 are an example of F6 triggering a drier cycle followed by a pause and a popoff and then a single compressor cycle. Note that no inline modifier has been added at the start or anywhere in the sequence to change the gain from the default, so this sequence will not have its volume modifiable by SCV_AIR_VOLUME.

Lines 239 to 262 is a crossing gate horn sequence example triggered by F7 ON. Note that this whole sequence is started by a F7 ON condition and then F7 does not have to persist, since the sequence will run to completion with no loops. The line 241 qualifier of "NO_PREEMPT_TRIG" means that the whole sequence will complete before any queued higher priority sound in channel 2 can run.

The balance of channel 2 sequences is just F9 that triggers a brake squeal on demand and is a good candidate for being increased in capability and automatic logic. Function 8 is not represented, since its mute action was incorporated in channel 1 programming.

Scheme 0 channel 3 is programmed from lines 276 to 334.

The highest priority sound is that of the "Dynamic Brake fans" in lines 280 to 285. This sequence starts the dynamic fan sound on F5 active ON and loops the sustain fragment on line 284 until F5 goes OFF, whereupon the fan ending sound is played. Volume for this sound is set by an inline modifier using a CV defined by the user as SCV_BRAKE_VOLUME [CV144].

The locomotive bell is animated by the sequence of lines 290 to 295. This plays a single bell strike with volume set by an inline modifier instruction to SCV_BELL_VOLUME, and then delays in line 294 for a period set by SCV_BELL_RATE. The initiate trigger in line 290 has a "RUN_WHILE_TRIG" qualifier so if no higher priority sound is present (e.g. dynamic brake fans) this bell striking will reoccur continuously while the TRIG_SF1 or F1 key is ON. The "NO_PREEMPT_TRIG" qualifier ensures that the entire sequence will complete before this sound can be preempted in this channel 3. Lines 297 to 309 have already been noted to control a persistent air-compressor sound triggered by Scatter task1 when F4 is ON. This task is preemptable immediately by either the bell or dynamic brake fans since the "ZAP" initiate qualifier is present.

Lines 313 to 332 shows another variation of inline modifier instructions that are used to ensure default values defined by the user are loaded into user defined CV's when the decoder encounters a TRIG_FACTORY_CVRESET action. This mechanism is provided so a factory stable or user defined default can be preselected. Note that CV152 and CV153 are also set up to define the author of the particular SDF.

This completes the overview of scheme 0 and the programming of SDL sound sequences in this example scheme for a diesel locomotive, and demonstrates a rich and novel SDL programming language approach with inline modifiers that is distinctly different and superior to the prior art of Severson '431

Steam Prime Mover Example:

The smaller scheme 1 following on lines 336 to 544 encodes a separate basic steam locomotive scheme, which has a number of structural similarities to the first diesel scheme 0. Items of identical form to those in scheme 0 operate in the same manner and will not need further explanation.

The salient difference in the Steam scheme 1 is that the prime move sounds different and has different operating states. Lines 370 to 381 are the sound sequence in channel 1 used to provide steam locomotive cylinder and exhaust sounds.

The line 370 initiate condition is a "TRIG MOVING" trigger that is provided by the decoder control software in response to speed commands. A qualifier of "RUN_WHILE_TRIG" means that this steam cadence or chuffing sequence will run persistently whenever the locomotive speed is moving, or non-zero. The associated inline modifiers are set up for a suitable BLEND rate, GAIN control for chuff volume via the CV value of SCV_PRIME_VOLUME and prime-mover chuff PITCH modification based on speed. The actual steam cadence is the four sound fragment playback commands on lines 378 to 381. The play loop-break condition for all four of these distinctively different chuffs of this particular steam locomotive is "loop_till_cam" loop-break trigger with a "loop_GLOBAL" qualifier. The "cam" break condition is a special form of trigger logic event that actually holds the channel in mute or silence until a cam trigger occurs, whereupon the sound fragment is then played and the play instruction is complete. This provides the chuff synchronization means, and an external hardware input line to the decoder can generate the exact cam trigger code for precise chuffs based on a cam switch, or an "Autochuff" mode may be selected that causes the chuff cam trigger events to be generated in proportion to the locomotive speed. The "loop_GLOBAL" qualifier forces the playback to terminate at a complete chuff when the initiate condition becomes not true, for fine control of the chuff sequencing.

A real steam locomotive is fairly quiet when not moving, except for; boiler, exhaust fan and operator sounds. To provide these ambient sounds when channel 1 is muted waiting for a cam trigger to produce a chuff, lines 503 to 505l provides persistent ambient "HNDL_STEAM_BOILER" sound in channel 2 at a low priority if no other masking sounds are running. The rest of the lines for channel 1 provide the F8 mute capability, so this is a fairly basic non-optimized steam sound scheme that is primarily present here to demonstrate a diesel and steam scheme can be easily placed in a single SDF. It is straightforward to add inline GAIN modifiers to change the cadence volume down when the engine is decelerating or coasting or at other speed and work thresholds as discussed for the diesel scheme.

Scheme 1 channel 2 is also the transient sounds for a steam locomotive. The F2 key now controls a playable whistle instead of air-horn. The other functions are similar to diesel locomotive equivalents. The TRIG_SF10 trigger is used to create a crossing gate sequence with a steam whistle.

Lines 432 and 433 encode a bell ring when the "TRIG_IN_0" or cam hardware input line is active, since this version of steam locomotive is configured to use "Autochuff" chuff timing and the external cam line is then free. An additional feature in line 438 shows a "GENERATE_TRIGGER" command issued when the TRIG_SF0 command is active, and this would additionally create a "TRIG_IN_0" trigger for line 432 to generate a bell sound instead of a hardware line action. In this way it is possible for a sound sequence and logic to powerfully cascade to other sound sequences.

Channel 3 of scheme 1 is the persistent sounds of a steam locomotive, and the bell is encoded for TRIG_SF1, like the diesel scheme. TRIG_SF0 on this channel is used to create the steam turbine dynamo sound when the F0 light function is active, and in fact a light can be then turned on using a decoder hardware control line. The remaining persistent sound is the steam powered reciprocating air-pump triggered by Scatter task1 and F4 ON. A background rail joiner "clackety-clack" sound could be added easily to this channel 3 with logic of a Scatter task based on speed and the locomotive moving. Lines 548 to 571 simply are used for verify the limits of the SDL resources used and complete the assembly process for the source file.

Having an extensible and consistently defined SDL allows for example, a SDF file (and even complete sound project) written for an earlier less-capable version of sound language (SDL) based sound scheme to be loaded into and correctly operate as a functioning subset within a higher capability more modern sound decoder. This ensures that the investment in SDF development and customization is protected and retained. In the ESU prior art, the transition to their second generation sound decoders in 2004 fundamentally changed the sound decoder structure such that the earlier project files, sound programming and control logic were not compatible with the older "classic" sound decoders. This forced ESU to provide an extra translation program and work step to try and overcome this user inconvenience.

In the case of the new art, when a more capable SDF is loaded into an older sound decoder, some simple fall-back rules allow most of the functions to be seamlessly operable at a reduced capability. For example if a four channel SDF is loaded into a three channel capacity sound decoder, the sound sequencer software could sensibly merge the last two source channels into the third channel of the decoder. Thus if the user chooses to write SDF sound schemes where the first two defined channels are the most important sounds e.g. prime mover and then user transient sounds like the whistle, then a concatenation of other channels is not a disastrous approximation. This flexibility and choice is a valuable and superior capability of a well-designed SDL based approach and implementation of a sound sequencing and generating means.

Lines 8 and 338 encode an "SDL_VERSION" instruction that signals the sound sequencer software the precise version of SDL language and also encodes the processing capability that has been assumed to generate this SDF. This allows the compatibility logic means of the sound sequencer software to determine how to automatically manage version and sound data format mismatches.

Downloading Embodiments:

FIG. 3 shows one aspect of an embodiment of downloading software suitable for this invention that runs under the Windows operating system. This is a configuration screen for the Digitrax "SoundLoader" GUI software designed to select SDF files and data structures and sound fragment files from a file selection list and then transfer this data via a PR2 sound programmer to a sound decoder or generator. FIG. 3 represents a complete 'sound project file', file type ".spj", that can be loaded from and saved to a disk file as a single integrated and encapsulated data ensemble that has all he needed data components and information to wholly update a sound decoder. The data includes an SDF file and all the assigned wave fragment files along with other configuration information. In this way the SDF and wave fragments can be handled as discrete separate elements or they can be processed and downloaded as a single entity. The "SoundLoader" program software has a comprehensive capability to modify all aspects of the download and configuration of a sound decoder and save this information to a disk file. Note that the download process includes "SoundLoader" intrinsic functions that correctly process the SDF, wave fragments, IPL and any other data with a defined protocol and suitable encapsulation header data to support a downloading sound programmer such as a Digitrax PR2. The data transport to a sound programmer may be encapsulated within an existing protocol such as the Digitrax LocoNet protocol with an extension for sound downloading such as the provision of a new LocoNet "D3" opcode and a new data carrying format. A preferred start download message to trigger a download would now be the six byte hexadecimal data string "D3,01,SMODE,tt,nn, CHK" where the SMODE value encodes a clear-text mode code for download operation, tt encodes a clear-text time parameter, nn encodes a clear-text count parameter and the CHK data byte encodes a LocoNet checksum that follows conventions of the publicly disclosed Digitrax LocoNet Personal use edition on the digitrax web site. The tt and nn parameters may optionally be zero.

For the data-transport phase of downloading it is useful to introduce a new data construct 1270 within the Digitrax LocoNet capability and the conventions used for LocoNet message strings:

<D3><08><HNDL><BLKLO><BLKHI><CHK>[data (BLK)][ECB]

Here the consecutive bytes D3 and 08 define that the message contains a following block of binary wave fragment data to be loaded into a sound generator-stored wave fragment indexed by the value HNDL, with a length BLKLO and BLKHI. CHK provides a normal checksum for a 6-byte LocoNet message. This novel form message has a new binary block of consecutive 8 bit binary data bytes, [data(BLK)], of the disclosed length followed by an [ECB] checksum byte for the binary data block, that follows a standard LocoNet message encoding. This is just one example of aspects of a new protocol that are used to support downloading.

The actual form of this protocol is not limiting to this invention with the exception of synchronizing means, because it is a defined means to support the communication of important data elements to a sound decoder, in the same way that a Windows operating system data file structure is not important as compared to the application-accessible file contents.

Item 12 is a listing of all the sound fragment files in the project and used in the SDF file selected by item 18. Item 19 is an example of a file that has been defined for a "bell" sound, and is highlighted because it is selected and this selection opens another edit window, item 13, which allows the user to configure and assign the bell sound fragment desired. Item 13 allows the sound fragments to assigned, deleted and changed as the edit command list shows.

Item 14 is provided so the user can erase or clear the whole fragment and SDF storage memory, and then start downloading the selected SDF file, using button item 15 and button item 16 to download all of the .wav fragments edited into window item 12. Item 17 is a single button that conveniently performs the same function as consecutively pressing items 14, 15 and then 16.

The actual sound fragments may be retrieved from a source recording, edited and converted into the correct data format by any one of many Microsoft Windows compatible sound editors, an example of which is "MySoundStudio" authored by Stomp software. The optimal format for low cost small-speaker systems is mono ".wav" Windows type sound files with 8 bit PCM samples and an 11,025 samples per second rate. This provides for the most compact and lowest cost sound storage requirements in the decoder. For a more demanding user it may be desirable to have 16 bit sample PCM sample files at a higher sample rate for a wider frequency response and better signal to noise ratio that can be appreciated in higher-cost sound generators with better speaker systems. The "SoundLoader" program logic incorporates a coding for the detected source ".wav" file format seen in the headers of the data to be downloaded, and this allows the sound sequencer software to know for each downloaded sound fragment the exact data coding format used. This then permits the sound sequencer software means to automatically assign memory storage based on the quality and capability parameters set up by the "SDL_VERSION" instruction since this encodes the rules and assumptions used for the SDL version being used by the SDF file. For example, if 16 bit PCM data is being downloaded that is encoded at a faster rate than 11,025 samples/sec and the SDF version only specifies 8 bit data, then the downloading function can automatically resample the incoming download data to 8 bits and the correct 11,025 samples/sec rate, using well known sampling algorithms, and then store this more compact data stream in memory. This allows an automatic format processing that remains functional even if users mix sound fragments of differing quality and encoding. At playback, if a lower sample or data rate fragment is selected it can be expanded and resampled by well-known interpolation algorithms to play correctly even if it has lower quality. This added logic helps ensure a most flexible product with maximum user configurability.

FIG. 4 shows the elements of the SDL language components and the flow required to implement a download capability. Item 20 represents the user's SDL source file, for this Listing 1 example this is "EVO_5741.asm". Item 21 represents the transformation step such as the MPASM Macro-Assembler that converts the SDL source to an object or hex file for further processing item 22. Item 24 is the downloader software means, such as the Digitrax "SoundLoader" program that selects the SDL object file from item 22, converts it to a file in the required .SDF format and combines it with selected sound fragment files of item 23 and then formats and communicates this data combination over a command input means to a sound programmer device or means item 25, such as a Digitrax PR2 sound programmer. [Item 24 can also select a separate IPL data file for download to an appropriate sound decoder.]

Programmer control logic in item 25 then processes the formatted download data to produce a track programming control waveform, such as that shown in FIG. 5, that is conveyed to the programming track item 27 via programming output means item 26 as an input connection to item 29. A sound decoder means item 29 with a connected speaker means item 30 and a motor means item 36 is mounted in locomotive item 28 and is placed in programming track item 27. This completes the logical flow and connections between the initial user SDL source file item 20 and sound decoder means item 29.

IPL Downloading:

Since the SDF files, sound fragment ".wav" files and decoder software IPL files are downloaded to the sound decoder across the easily accessible programming track item 27 it is possible for unauthorized users and other devices to "spoof" the download process and intentionally or unintentionally introduce malicious or non-functioning data at the steps of item 24 or item 25. To prevent this, the IPL data content is encrypted and the sound decoder being programmed must process a correct defined embedded "IPL data signature" and also verify the IPL encoded manufacturer ID, product ID, hardware version and software versions are correct and compatible before allowing an IPL to begin. Additional consistency checks are embedded throughout the encrypted IPL data and an overall data validity check is also provided. Any deviations or other suspicious information and the sound decoder will exit the IPL process, and the decoder will be left in a safe state to reattempt a valid IPL. This is important since the IPL data is used to animate one or more controller devices in the sound decoder and if these are compromised, hardware damage may occur. It is not practical for any encryption to be embedded in the publicly distributed item 24 downloader software means, since this is insecure and the security may be "hacked" in the Windows operating system environment. Item 25 and item 29 both incorporate internal copy protection and reverse-engineering prevention means, so these two items at either end of the programming track connections may employ the encryption, verification and decision means without a problem. Note that the IPL file is actually created and encrypted by the sound decoder manufacturer, not the user, and then can be provided securely for public use to reload the operating decoder software modules, by employing the existing item 24 through item 27 infrastructure.

An additional downloading security step is to use any existing IPL encryption capability present in item 25 and item 29 to ensure the SDF and sound fragment download process is happening with "trusted" or competent software and devices but user modified sound configuration data. It is straightforward for a predetermined and predictable signature to be encrypted by item 25 and communicated to item 29 at the start of a download session as a specialized version of the often-used challenge-response verification method. The most important open link is across the programming track, so item 29 can easily verify that item 25 is present by decrypting the predictably changing signature encrypted and added to the data flow by item 25. The signature may be easily developed from a unique changing time-stamp and/or end counter flags sent in clear-text form at the beginning of the download session by item 29 or less securely from item 24. This may be combined in a logically obscuring manner to form a changing signature that is then encrypted with a new key to ensure security. Since a new download cannot occur immediately, it is not practical for a hacker to mount an exhaustive search for the signature with practical encryption strengths, and the hacker cannot simply repeat a captured and copied track waveform or signal since the correct reply signature changes constantly.

Download Mode Synchronization Method:

FIG. 5 shows a time voltage graph of a track waveform generated by item 25 and present on item 27 to allow programming and downloading of sound decoder means, item 29. Note that the width or the square waves in FIG. 5 is used to delineate different coding scheme groups and not imply a particular data rate. Since a primary track-encoding scheme used by many modern sound decoders is NMRA DCC and this allows programming of CV's, this is a waveform coding that is possible in the initial time period item 31 of FIG. 5.

The DCC "broadcast reset" packet waveform is present when the decoder first needs to be powered up and this changes to DCC control packet waveforms as required subsequently for programming and other operations. For CV programming the DCC packets used are clearly defined and well-known and there is no problem for item 25 to read and write decoder CV's in item 29 using standard NMRA methods. At initial power on it is useful for item 25 to automatically read a number of CV's from item 29 to verify the model and type of the decoder, and also gather other data such as a 'download ends-seen' counter if the detected decoder model is known to support this.

However the CV and NMRA coding methods have a best peak data rate of about 8,000 data bits per second, and are too slow for downloading of large sound fragment file groups that can be up to several megabytes. So if downloading is required by item 24, it is necessary to change to a different data encoding method during the download-mode. When a user activating e.g. item 15 or item 16 requests download in item 24, an initial "start download" command is encoded and sent to item 25.

FIG. 5 Item 31 shows a first digital track encoding that is terminated by a mode-change-mark item 32, which is a defined period where no track voltage transitions occur and is arranged to be an invalid coding element in any of the track encoding formats in use. Thus this invalid element mode-change-mark item 32 provides a point that a decoder device low-level hardware and software logic can infer a coding change is possible, or there is a problem with the track waveform encoding.

To correctly set up a mode change the last coding element of the item 31 first digital track encoding is arranged by a synchronization logic means in item 25 to provide a unique start-trigger sequence in response to a "start download" command that in combination with mode-change-mark item 32 form a unique synchronization pattern that precisely and uniquely encodes a download start-sequence programming mode change event for a decoder to detect.

If the first digital track encoding item 31 is, for example NMRA DCC, encoding one of many suitable unique start-triggers would be a NMRA CV programming command to a reserved CV number such as CV1024 with a data value that encodes the download-mode to be used. The occurrence of a unique encoded start-trigger as the end sequence of item 31 then forewarns the high-level decoder software decoding the programming track waveform to expect a different encoding method using the defined download-mode to become active, and the mode-change-mark item 32 provides an additional low-level hardware-synchronizing identifier that in combination mark a download start-sequence.

After the unique download start-sequence mode change provided by the combination of item 31 and item 32, the programming track waveform changes to a second digital track encoding item 33. This second encoding method is designed to provide a higher data-encoding rate than the first digital track encoding, and can be implemented with one of many choices, such as Pulse Position Modulation encoding or data in an Asynchronous Non-Return Zero (NRZ) coding format.

If an Asynchronous NRZ coding is used the, mode-change-mark item 32 provides a period for the hardware-level logic to automatically determine the track idle-state or "marking" voltage levels and polarity, since a locomotive can be placed in either direction on the programming track. This is required by the low-level hardware and software logic that is used to synchronize, time and extract data when an Asynchronous NRZ coding method is used. A suitable Asynchronous NRZ coding would be a 1 start bit, 8 data bit and 1 stop bit, no parity format at a 57,600 bits per second rate, which can be sustained by most Windows operating systems and is almost ten times faster than the NMRA DCC peak data encoding rate.

When the mode change to downloading is complete and data is being received at a higher rate such as a new encoding at item 33, the initial download start-sequence is first encoded in the new mode to allow the decoding software to again verify that the expected mode change and download-mode has occurred. At this point all the set up messages are in 'clear-text'.

After a programming mode change to download mode the item 25 programmer can use 'clear text' data already read back non-volatile data from item 29 decoder that changes at each programming mode change, such as a 'download ends-seen' counter and can use this as a seed-value to scramble or obscure a defined "signature data string" that then is encrypted to become a 'validation message' that then sent to, and is now only sensibly verifiable by item 29. The scrambling and encryption means are secure and only known to item 25 and item 29, and are sufficiently complex that they cannot be exhaustively searched for in real time since the download algorithms do not allow continuous programming mode changes, and it is not possible for a recorded track waveform to simply be replayed from a prior session since the signature will not be valid. This programmer validation means ensures that item 29 can verify that the item 25 programmer is a "trusted" and non-malicious device. The encryption used can conveniently be the same algorithms present for use by the IPL download means but simply using a new encryption key.

A variation for generating a 'validation message' is the use of a changing 'clear-text' seed-value provided by item 24 of FIG. 4 and is visible as 'clear-text' to both item 25 and item 29. This is fine for the development of a clear-text seed-value for a 'validation message' but no underlying encryption and scrambler means should be encoded in item 24, as this is less secure since any algorithm that runs under the Windows Operating system can be hacked and can be detected.

In this way the item 29 secure decoder software can accept new mode data as 'clear-text' and then apply a decryption and signature verification means to be sure that the item 25 programmer is a "trusted" and non-malicious device. If the download mode change is not properly verified, the item 29 decoder simply exits downloader mode increments a 'download ends-seen' counter and ignores commands until a minimum time period has elapsed then waits until a first digital track encoding is detected and a new download or other task can be started.

Item 34 is a second digital track encoding at the end of the download process and is arranged to provide an "end download" command. At this point the track encoding changes back to the first digital track encoding, as item 35, and item 29 decoder increments a 'download ends-seen' counter. The exit from download programming mode is not so critical because the fallback e.g. following NMRA CV or digital operating modes, are not "secure" and cannot corrupt the downloadable portions of item 29.

GUI Configuration Interface Extensions:

Although the SDF schemes defined in Listing 1 are in a most precise text line format, it is a straightforward task to arrange an additional GUI type interface for item 24 so the user can assemble or compile and control a modified SDF data file. The "SoundLoader" software reads the "EVO_5741.hex" binary and "EVO_5741.1st" list files created when the user SDL source file "EVO_5741.asm", item 20, was processed by the MPASM Macro-Assembler, and creates a working binary SDL compatible file "EVO_5741.SDF" file. Since "SoundLoader" can process these file structures it can then also offer additional edit windows into the well-defined source file structure and then allow this to be edited in a convenient GUI object-oriented manner. The "SoundLoader" program can also be modified to perform the required symbolic assembly task of the SDL language source as well, or it can simply launch an invocation of a command-line version of MPASM as a separate program task thread under the Windows operating system.

This would provide a convenient way for users to work with an existing source file structure and then add to or modify the; priority (position), fragment handles, trigger initiate logic, loop-break logic and also change the logic and mathematical calculations at any line in the source file. This would provide a GUI configuration capability similar to the ESU state-machine prior art but without the noted limitations of user flexibility and configurability.

The binary format of the SDL instructions and parameter encoding are defined by the Snd_cmd.INC file and these bit patterns are found in the final SDF data file. This binary data would be considered the basic "natural language instructions" of the SDL and these can be processed within a number of execution means. It is possible for a general-purpose microprocessor or DSP means with a different native language or assembly level code set to be configured with an interpretation algorithm or program to read and process SDF files to derive the correct resulting sound and control outputs. Alternatively it is possible to configure a logic device means such as a logic array of gates or FPGA etc, to be able to read and process the SDL instructions as a "native" instruction set and hence process with logic or micro-coded instructions the SDF data without performing an interpretation step. Both synthesis means may be used in an operating embodiment and the important point is the correct sound and control outputs that will result from using a correctly configured SDF file that is based on the SDL method taught here.

Sound Decoder Power Management:

Many prior art decoders have elevated power consumption requirements that lead to problems on energy-limited programming tracks, and even on layouts when a number of sound decoder equipped locomotive may operate on a single area of tracks and where the power supplying boosters have a finite current capacity. This problem can be so acute that some model railroad clubs have banned certain types of sound equipped locomotives from their digital layouts. This is because extra power is needed for the sound generator amplifiers, storage memory and the fact that the decoder controllers run more complex algorithms faster, which require more power.

Thus careful power management is required to ensure that new art sound decoder equipped locomotives can operate as well as standard decoder units with no usage restrictions or adverse impact or prior investments in layout control equipment such as booster and wiring.

In most locomotives volume is limited, so energy storage devices such as capacitors or batteries that may be employed to ensure decoder and sound operation is maintained for short track power interruptions, need to be minimized in size.

Prior art sound decoders place a large energy storage device in the decoder installation that is typically connected to the DC output terminals of the input bridge rectifier. The problem with this approach is that motor power consumption during any track power interruption also continues, and this power draw is very significant and limits the achievable power hold over time.

FIG. 6 shows a new art sound generator or decoder that is optimized for best power hold over time and that allows operation on power limited programmers and digital layouts. Item 49 represents the layout track power source and can also be a programming device track output. Item 37 is an input connection means between the decoder and track power source and can be a direct wired connection or locomotive or similar power pickups. Item 38 is the input bridge rectifier that provides a DC power output for decoder operation with a positive connection means item 39. The motor control H-Bridge item 40 gets this DC power output and with a connection from a decoder control logic means 46, controls and senses the DC motor item 41, which can be omitted for sound only generation. This configuration allows the sensed motor voltages to be employed by decoder motor control logic for back-emf motor speed stabilization and the actual motor load may also be made visible in a user work register for further sound modification using inline modifiers and SDF logic means.

Item 45 represents a power storage means, incorporating a capacitor or battery device and is connected to the decoder logic power supply means item 44, by a charging control means item 43. To ensure that the motor control H-Bridge item 40 cannot drain power from item 45 when track power is interrupted, a power blocking diode means item 42 is added back to the positive connection means, item 39. Decoder logic power supply means item 44 is typically an efficient power conversion means such as a wide input-voltage range SEPIC converter and provides the regulated low voltages needed by decoder control logic means 46 and sound generator control logic means 47, which are typically in the range of 2 to 5 volts DC.

Input connection means 51 communicates the track voltage waveform to decoder control logic means 46 which incorporates a decoder control software means that allows the decoding of data and commands from these track waveforms. Item 50 is an example of a function output means that may be used to control an external device such as a light by modulating a control voltage. Sound generator control logic means 47 incorporates; a communication link with the decoder control logic means 46, a sound sequencer software means, an SDF data and sound fragment data storage memory means and a sound output means that converts digital data to processed analog sound data that is then conveyed to the speaker means item 48.

Items 46 and 47 may in fact be realized in a single control logic or microprocessor means, so the functional capability of each unit is presented here in a logical manner that does not limit the way these means are physically synthesized. Downloading and security means is a further capability that requires additional logic and functions in both items 46 and 47. The items grouped in FIG. 6 are configured so that they can implement the means to execute the SDF files based on the SDL concept and hence form a working sound generator or decoder that can be controlled by encoded action commands, based on this disclosure.

The provision of power blocking diode means, item 42, ensures that power stored in item 45 power storage means is available to solely to power the decoder items 46, 47 and 48 via the decoder logic power supply means item 44, and this ensures the best possible hold up time when track power is interrupted, since no motor current is provided from this storage means.

The charging control means item 43 is critical and is designed to ensure the decoder does not overload programmers or track power boosters due to the initial charging currents for item 45 power storage means. Item 43 can most simply be implemented with a power resistor and a low loss rectifier as shown in the contents of the item 43 means. This resistor is chosen to limit the peak current that the power storage means can draw at maximum track voltage, and a sensible value for this is approximately the motor stall current, since this is the most current that could be drawn by the decoder at power up if the decoder control logic did not supervise power up sequencing wisely. This suggests this resistor would be similar in value to the motor load resistance, typically 8 to 12 ohms for modern HO locomotives. The low-loss e.g. schottky diode shown in item 43 is provided so that when decoder logic power supply means item 44 runs off the stored energy of item 45 power storage means, there are minimum voltage or power losses. Note that a more complex constant-current charge control device or circuit may be substituted for the resistor shown at a higher cost, and that MOSFET devices can be used both as current control devices here and also as low-loss third quadrant rectifiers. The decoder control logic means 46 also implements an intelligent power up control algorithm means that ensures the initial charging currents have fallen off before the motor runs, and can also test the power capability of the track power source by drawing an additional current and measuring any voltage drops seen on the track. For power-limited operations such as low capacity DC power packs this intelligent algorithm allows the decoder to adaptively run the sound at a lower volume to minimize power draw.

Having thus disclosed the preferred embodiment and some alternatives to this embodiment, additional variations and applications for this invention, such as use in sophisticated amusements and toys, or appliances with downloadable sound, will be apparent to those skilled in the art of decoder, software and electronic design, with minimal extra effort. Therefore, while the disclosed information details the preferred embodiment of the invention, no material limitations to the scope of the claimed invention are intended and any features and alternative designs that would be obvious to one of ordinary skill in the art are considered to be incorporated herein.

Consequently, rather than being limited strictly to the features disclosed with regard to the preferred embodiment, the scope of the invention is set forth and particularly described in the following attached claims.

What is claimed is:

1. A method for generating a download synchronization waveform pattern as a track programming control waveform from a programmer device, comprising at least:

a) providing a command input source, connected to, b) a programmer device, comprising at least:

(i) a programmer control logic capable of control logic, including at least decoding and executing programming commands received from said command input source, that communicates with a, (ii) synchronization logic that can generate consecutive unique start-trigger and mode-change-mark waveforms at a programming output after a defined start download encoded data string programming command is received by said programmer control logic, that is conducted to, c) said programming output that connects to a programming track means, whereby the receipt of said defined start download encoded data string causes the formation of said start-trigger and mode-change-mark waveforms as said download synchronization waveform pattern at said programming track means that a connected decoder uses for triggering a downloading mode.

2. The method defined in claim 1 with the addition of a decryption and signature verification capability in said programmer device, to ensure reliable downloading and/or protection from tampering by any device attempting to impersonate the functionality and/or trusted authority of said programmer device.

3. The method defined in claim 2 wherein clear-text seed-values employed by said decryption and signature verification capability for protection from malicious tampering are provided by said command input source.

4. The method defined in claim 2 with said connected decoder additionally configured to employ a compatible decryption and signature verification capability to validate and ensure reliable downloading from said programmer device, thus providing protection from an untrusted source and/or malicious tampering with any download data.

5. The method defined in claim 1 wherein said defined start download encoded data string programming command comprises a six-byte hexadecimal data string.

6. The method defined in claim 1 wherein said start-trigger and mode-change-mark waveforms are a first track data-encoding waveform of an NMRA DCC format encoding that precedes and signals a predetermined change to a different second track data-encoding format.

7. The method defined in claim 6 wherein said second track data-encoding format conveys downloadable data at a higher data encoding rate than an NMRA DCC waveform and permits downloads of IPL and/or other data.

8. The method defined in claim 1 wherein said command input source is comprised of a connected personal computer configured to provide downloader and/or programming software functionality.

9. The method defined in claim 1 wherein said command input source is a remote internet and/or network connected device configured to provide downloader and/or programming software functionality.

10. An apparatus for generating a download synchronization waveform pattern as a track programming control waveform from a programmer device, comprising at least:

a) a command input source connected to, b) said programmer device, further comprising:

(i) a programmer control logic capable of control logic, including at least decoding and executing programming commands received from said command input source, that communicates with a, (ii) synchronization logic that can generate consecutive unique start-trigger and mode-change-mark waveforms at a programming output after a defined start download encoded data string programming command is received by said programmer control logic, that is conducted to, (iii) said programming output that connects to a programming track means, whereby the receipt of said defined start download encoded data string causes the formation of said start-trigger and mode-change-mark waveforms as said download synchronization waveform pattern at said programming track means that a connected decoder uses for triggering a downloading mode.

11. The apparatus defined in claim 10 with the addition of a decryption and signature verification capability in said programmer device, to ensure reliable downloading and/or protection from tampering by any device attempting to impersonate the functionality and/or trusted authority of said programmer.

12. The apparatus defined in claim 11 wherein clear-text seed-values employed by said decryption and signature verification capability for protection from malicious tampering are provided by said command input source.

13. The apparatus defined in claim 10 wherein said defined start download encoded data string programming command comprises a six-byte hexadecimal data string.

14. The apparatus defined in claim 13 wherein said start-trigger and mode-change-mark waveforms are a first track waveform of an NMRA DCC track data-encoding format that precedes and signals a predetermined change to a different second track data-encoding format that then conveys downloadable data at a higher data encoding rate than an NMRA DCC waveform and permits downloads of IPL and/or other data files.

15. The apparatus defined in claim 10 wherein said command input source is comprised of a connected personal computer configured to provide downloader and/or programming software functionality.

* * * * *